US005757397A

United States Patent [19]

Hirano et al.

[11] Patent Number: 5,757,397

[45] Date of Patent: May 26, 1998

[54] RECOVERY MECHANISM AND INK JET RECORDING APPARATUS EQUIPPED THEREWITH

[75] Inventors: Hirofumi Hirano; Hitoshi Sugimoto, both of Yokohama, Japan

[73] Assignee: Canon Kabushiki Kaisha, Tokyo, Japan

[21] Appl. No.: 55,757

[22] Filed: May 3, 1993

Related U.S. Application Data

[63] Continuation of Ser. No. 735,114, Jul. 24, 1991, abandoned, which is a continuation of Ser. No. 455,131, Dec. 21, 1989, abandoned.

[30] Foreign Application Priority Data

| | | | |
|---|---|---|---|
| Dec. 21, 1988 | [JP] | Japan | 63-323011 |
| Jan. 13, 1989 | [JP] | Japan | 1-7288 |
| Jan. 13, 1989 | [JP] | Japan | 1-7289 |
| Jan. 13, 1989 | [JP] | Japan | 1-7290 |
| Jan. 23, 1989 | [JP] | Japan | 1-13492 |
| Jan. 23, 1989 | [JP] | Japan | 1-13493 |
| Jan. 23, 1989 | [JP] | Japan | 1-13494 |
| Jan. 23, 1989 | [JP] | Japan | 1-13495 |
| Jan. 23, 1989 | [JP] | Japan | 1-13496 |
| Jan. 23, 1989 | [JP] | Japan | 1-13497 |
| Feb. 28, 1989 | [JP] | Japan | 1-47412 |
| Jun. 2, 1989 | [JP] | Japan | 1-139309 |
| Jun. 2, 1989 | [JP] | Japan | 1-139319 |

[51] Int. Cl.[6] ..... B41J 2/165

[52] U.S. Cl. ..... 347/30

[58] Field of Search ..... 346/140 R, 75; 400/126; 347/29, 30, 31, 33

[56] References Cited

U.S. PATENT DOCUMENTS

| | | | |
|---|---|---|---|
| 2,185,215 | 1/1940 | McCabe et al. | 248/23 |
| 2,791,126 | 5/1957 | Christopher | 74/242.13 |
| 3,628,645 | 12/1971 | McFenters et al. | 197/90 |
| 3,957,150 | 5/1976 | Cappotto | 197/90 |
| 4,459,600 | 7/1984 | Sato et al. | 346/140 R |

(List continued on next page.)

FOREIGN PATENT DOCUMENTS

| | | |
|---|---|---|
| 0094220 | 11/1983 | European Pat. Off. . |
| 59-14964 | 1/1984 | Japan . |
| 59-45161 | 3/1984 | Japan . |
| 53-123670 | 7/1984 | Japan . |
| 59-138461 | 8/1984 | Japan . |
| 2203994 | 11/1988 | United Kingdom . |
| 88-08370 | 11/1988 | WIPO . |

OTHER PUBLICATIONS

"Internal Cleaning Unit Resolves Traditional Ink–Jet Limitations", Pietraszkiewic, et al., Computer Technology Review, Fall, 1984.

"Floating Motor Mount", Brumbaugh, et al., IBM Technical Disclosure Bulletin, vol. 21, No. 10, Mar. 1979.

*Primary Examiner*—Benjamin R. Fuller

*Assistant Examiner*—N. Le

*Attorney, Agent, or Firm*—Fitzpatrick, Cella, Harper & Scinto

[57] ABSTRACT

An ink jet printing apparatus has a carrier that mounts a print head for movement between a printing region and a non-printing region by rotation of a lead screw. A cap in the non-printing region has two adjacent chambers and is moved between a contact position, in which the cap covers a discharge port forming surface of the print head, and a retracted position. One cap chamber seals the discharge port from the atmosphere and the other is connected to a suction pump to apply suction to a discharge port in the print head. In one embodiment the area of the cap in contact with the print head when the suction chamber is covering the discharge port forming surface is smaller than the area when the sealing chamber is covering it. Rotational movement of the lead screw can be used to move the cap and operate the suction pump.

5 Claims, 39 Drawing Sheets

U.S. PATENT DOCUMENTS

| | | | |
|---|---|---|---|
| 4,494,887 | 1/1985 | Wincent | 400/568 |
| 4,533,927 | 8/1985 | Iwagani et al. | 346/140 R |
| 4,543,589 | 9/1985 | Terasawa | 346/140 R |
| 4,558,333 | 12/1985 | Sugitani et al. | 346/140 R |
| 4,577,203 | 3/1986 | Kawamura | 346/140 R |
| 4,631,556 | 12/1986 | Watanabe et al. | 346/140 R |
| 4,739,340 | 4/1988 | Terasawa | 346/140 R |
| 4,746,938 | 5/1988 | Yamamori et al. | 346/140 R |
| 4,825,231 | 4/1989 | Nozaki | 346/140 R |

RECOVERY MECHANISM AND INK JET RECORDING APPARATUS EQUIPPED THEREWITH

This application is a continuation of application Ser. No. 07/735,114 filed Jul. 24, 1991, now abandoned, which in turn is a continuation of application Ser. No. 07/455,131 filed Dec. 21, 1989, now abandoned.

BACKGROUND OF THE INVENTION

1. Field of the Invention

This invention relates to an ink jet recording apparatus which is applicable to various printers, and printer portions to be applied to various instruments.

2. Related Background Art

This kind of apparatus is equipped with a constitution inherent in the system which performs recording by discharging ink other than the constitution concerned with direct recording.

More specifically, corresponding to the recording data, when no discharging is performed at the discharge port or when the apparatus itself is not used for a long term, the ink at the discharge port or within the ink liquid chamber communicated to the discharge port may be sometimes increased in viscosity to cause non-discharging. Also, ink liquid droplets, water droplets or dust, etc. may be deposited on the discharge port surface where the discharge port is arranged, whereby the ink liquid droplets may be sometimes drawn by these deposits to be deflected from the discharging direction. For this reason, the ink jet recording apparatus is equipped with various constitutions as the so called discharging recovery system for preventing previously non-discharging or deflection of the discharging direction.

As these recovery systems, for the constitution which prevents non-discharging, there is preliminary discharging which removes ink which is increased in viscosity, etc. by discharging ink onto a predetermined ink receiving medium, ink suction which performs the above-mentioned removing operation by sucking ink from the discharge port or the ink liquid chamber, and further capping which prevents ink solvent evaporation from the discharge port by closing the discharge port surface.

Also, for the constitution to prevent deflection of the discharging direction, there is a constitution which wipes the discharge port surface, thereby removing dust, ink liquid droplets, etc. deposited in the vicinity of the discharge port.

On the other hand, in the ink jet recording apparatus, particularly recording heads in recent years, preparation is now performed by film forming steps of semiconductors or microworking techniques, whereby smaller and less expensive recording heads are going to be realized. Also, recording heads of the disposable type, for example, integrated with an ink tank have been proposed.

As the result, it has been desired to provide an ink jet recording apparatus which can be used handily by users by making the apparatus itself small in scale and low in cost.

Whereas, for realizing the ink jet recording apparatus as described above, particularly the apparatus which is of small scale and low cost, and further is the disposable type, there are various tasks to be solved.

These tasks exist primarily in the constitution for discharge recovery as described above, and miniaturation of the apparatus is hampered by preliminary discharging, ink suction, and further the space for arranging the apparatus for capping. Also, miniaturization of the apparatus is also hampered by the space for the waste ink deposited tank for storing waste ink by preliminary discharging or suction, and the suction pump, tube, etc. for leading waste ink thereto.

Of the constitutions of the above-mentioned recovery systems, particularly in the constitution of performing capping, it has been practiced in the prior art to use the cap for preventing ink evaporation by closing the discharge port from the air with the cap to be used for sucking ink front the discharge port for eliminating clogging, etc.

For this reason, ink solvent is evaporated from the tube to be communicated to the suction pump or these connecting portions, etc., whereby there was a problem that insufficient suction after closing with the cap resulted.

The constitutions of the above-mentioned recovery systems, particularly the constitution comprising storing waste ink absorbed proposed in the prior art, include the constitution in which a waste ink tank is provided at a predetermined position of the apparatus and waste ink is discharged there, the constitution in which a plate-shaped ink absorbing member is disposed internally of the apparatus and waste ink is discharged there to promote evaporation, and further the constitution in which these ink absorbing members are made replaceable.

However, according to the constitutions as described above of the prior art, the space for a waste ink tank or ink absorbing member must be ensured, whereby there was a problem that the apparatus became enlarged.

Also, there has been known in the prior art a constitution in which waste ink is recovered into an absorber provided in a separate chamber of an ink cartridge. However, since this constitution is a constitution in which ink is collected by inserting the needle at a tube tip end for guiding waste ink into the rubber cap of the cartridge, the absorbing ability of the whole absorber could not be taken advantage of, and consequently it could not be utilized except for the disposable type.

Also, in the recovery system, since the connection tube from the cap to the pump, the drain tube from the pump to the waste ink tank are required, the constitutions of these apparatuses become complicated, and also there was involved the problem that the space for arrangement of the tubes was necessary.

Also, due to the presence of the tubes, evaporation of ink solvent from the tubes increased, whereby the ink within the tube or in the vicinity of the discharge port increased in viscosity, until it was finally deposited.

Further, since a one-directional valve is provided on the piston shaft, a certain area is required for the piston shaft end for the arrangement portion thereof. For this reason, the diameter of the piston becomes greater, which led to the problem that the pump itself became larger. Also, in this pump, since the load on the solid rubber generally used for formation of the main piston is great relative to deformation, the actuation force of the piston became nonuniform, whereby stable suction actuation could not be performed in some cases. Also, the piston of solid rubber is poor in durability, having poor resistance to dust, etc. which can be brought in by suction, whereby the suction effect may be sometimes markedly lowered.

Also, as shown in Japanese Laid-open Patent Applications No. 59-14964, No. 59-45161, there has been proposed a constitution of the system in which a blade portion such as rubber, etc. and a non-absorptive cap portion are provided in the circumferential direction and rotated while discharging ink. However, when the ink removed from the head with the blade is attached at the root in the vicinity of the blade, such ink, etc. cannot be removed even with the cleaning member arranged for cleaning the circumferential surface, which consequently caused the capping itself to be unstable or the cleaning effect to be deteriorated.

Anyway, none of the recovery means of the ink jet recording apparatus improved this operation when they are miniaturized.

SUMMARY OF THE INVENTION

A principal object of the present invention is to provide an ink jet recording apparatus which accomplishes miniaturization and stabilization of its function by improving the means having at least one recovery function which accomplishes miniaturization of the recovery means, preferably further improving its effect by miniaturizing a plurality of recovery means.

Another object of the present invention is to accomplish unification of the driving motor and miniaturization as a whole by utilization thereof.

Still another object of the present invention is to provide an ink jet recording apparatus which can maintain the ability to remove ink for a longer term and also improve the cleaning ability of the cleaning member itself, and further has accomplished miniaturization of the apparatus.

The object of the present invention in view of the tasks concerning the ink suction pump in discharge recovery as described above is to provide an ink jet recording apparatus having solved the above-mentioned problems concerning the piston which is a constituent part of the pump for suction.

Another principal object of the present invention is to provide an ink recovery mechanism which can utilize the maximum ink absorbing ability of a waste ink holding member, namely to provide an ink jet recording apparatus which requires no specific constitution for storing waste ink by providing an ink absorber internally of a conveying means such as paper delivery roller, etc. and introducing a discharging route for waste ink.

Still another object of the present invention is to provide an ink jet recording apparatus which can exhibit stable cleaning effect, wherein no inconvenience is caused by the removed ink generated when the recording head is subjected to cleaning.

Still another object of the present invention is to provide an ink jet recording apparatus, which is not enlarged of the apparatus even discharging for recording head recovery may be performed, the suction pump for recording having a cylinder and a piston for reciprocating within the cylinder, and having an elastic porous member as the inner layer as viewed from the sliding portion of the cylinder of the piston.

Further specific examples of the invention can be understood from the following description, and therefore are not described here in detail.

Specific characteristics are enumerated below.

1) An ink jet recording apparatus equipped with a cleaning member for cleaning the discharge port surface of a recording head, comprising:

a moving means for moving said recording head;

a stopping means for stopping said recording head in the cleaning region with said cleaning member;

a cleaning mechanism which enables cleaning only in the direction which is the crossing direction relative to the moving direction of the recording head by said moving means and directed from the upper portion to the lower portion of said cleaning region; and an ink absorber provided on the downstream side of said cleaning member with respect to said direction directed from the upper portion to the lower portion, integrally with and adjacent to said cleaning member.

2) An ink jet recording apparatus equipped with a recording head which performs recording by discharging ink through a discharge port and a means for performing a treatment which makes good the discharging state of said recording head by permitting ink to be discharged through said discharge port, comprising a cap member covering over the surface of said recording head having said discharge port formed thereon during said treatment, and said cap member being provided with a spherical seal portion formed integrally on the non-opposed surface side with the surface of said recording head and an ink channel for leading out said discharged ink by communicating said seal portion and the opposed surface side of the surface of said recording head.

3) An ink jet recording apparatus equipped with a recording head which performs recording by discharging ink through a discharge port onto a recording medium, and a means for performing treatment which makes good the discharging state of said recording head by discharging ink through said discharge port, wherein a waste ink holding member for holding said discharged ink is provided within a conveying means for conveying said recording medium, and also a waste ink guide member having a discharging portion for discharging ink primarily to the central region in the lengthy direction of said holding member by passing internally through said waste ink holding member.

4) An ink jet recording apparatus equipped with a recording head which performs recording by discharging ink through a discharge port onto a recording medium, and a means for performing treatment which makes good the discharging state of said recording head by discharging ink through said discharge port, wherein directional fibers having fibers arranged in the waste ink guide direction are provided in the waste ink conveying route to the waste ink holding member of said means.

5) An ink jet recording apparatus mounted with a recording head having a discharge port for discharging ink and equipped with a carrier movable through the recording region with said recording head and the region adjacent to said recording region, a cap capable of contact/release relative to the surface having formed said discharge port formed thereon arranged along said adjacent region, and a suction means for sucking said ink through said cap, wherein said cap is constituted of a closed cap portion having no communication port to outside and a cap portion for suction communicating to said suction means adjacent to each other.

6) An ink jet recording apparatus equipped with a recording head which performs recording by discharging ink through a discharge port and a suction pump which makes good the ink discharging state by sucking ink from said discharge port, wherein said suction pump has a cylinder and a piston moving in a reciprocal fashion through said cylinder, and has an elastic porous member as the inner layer as viewed from the sliding portion between said piston and said cylinder.

7) An ink jet recording apparatus which performs recording with equipment of a head for discharging ink corresponding to recording information and a carriage which moves said head in a predetermined direction, wherein a lead screw which moves said carriage by use of a plurality of lead grooves provided in spiral shape at the peripheral surface as the delivering means, and a regulating member joined to the end of said lead screw and also, except for one lead groove of said plurality of lead grooves into which driving members for said carriage are fitted, having members for impeding egress and ingress of said driving members for said carriage provided as faced to the ends of other lead grooves are provided.

8) An ink jet recording apparatus equipped with a carriage which moves in the main scanning direction with an ink jet head having a discharge port for discharging ink mounted thereon, wherein a lead screw for moving said carriage in a reciprocal fashion, a cap member arranged so as to enable capping over the surface where the discharge port of said head is arranged, a driving means for attaching and detaching of said cap member relative to said head, a sucking means for creating a negative pressure with said cap member and a means for capping said cap member over said head by transmitting the rotation of said lead screw in the process of said carriage penetrating from the recording region to the non-recording region to said driving means and also actuating said sucking means are provided.

BRIEF DESCRIPTION OF THE PREFERRED EMBODIMENTS

The present invention will hereinafter be described in detail with reference to the drawings.

Figure 1:
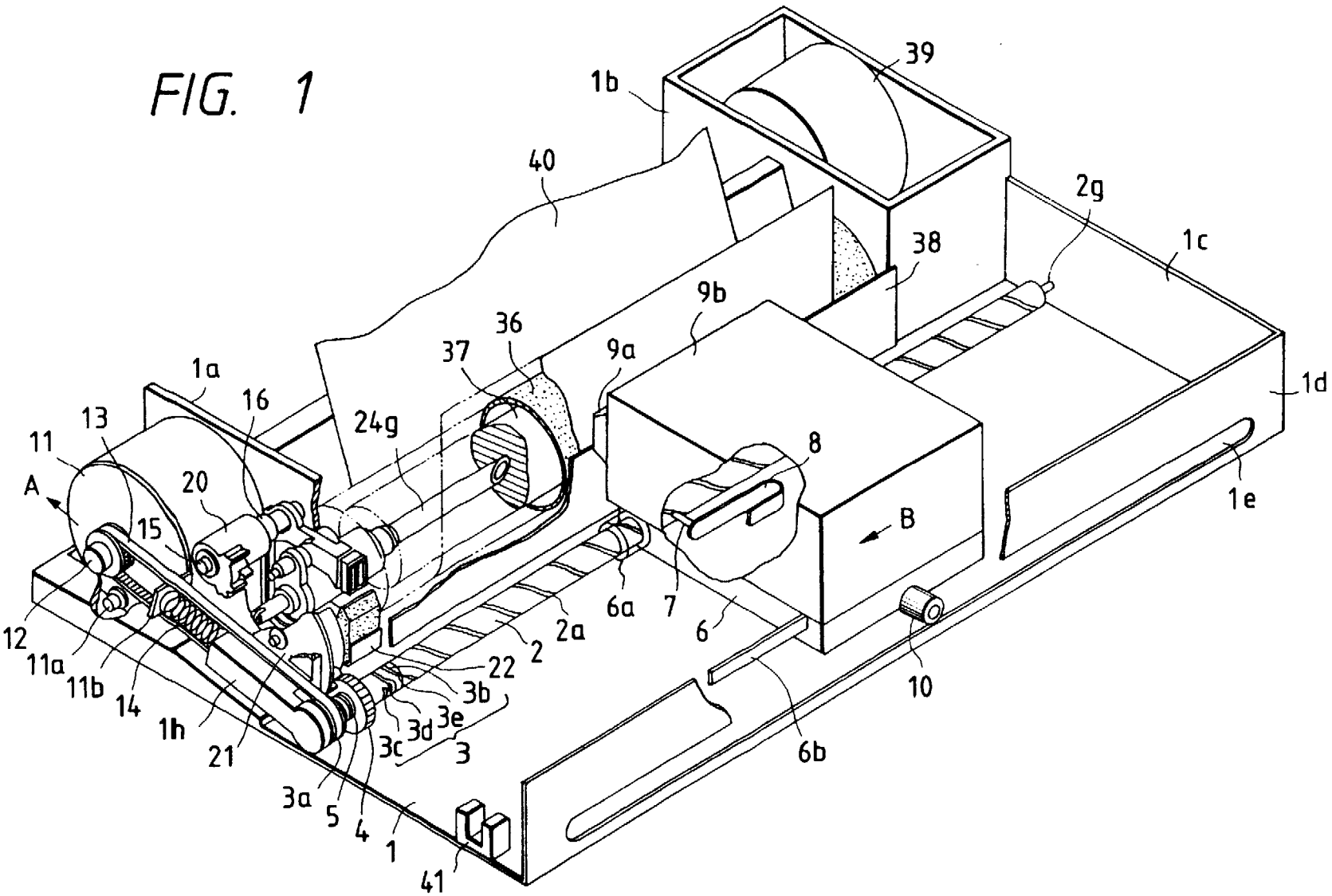
FIG. 1 is a perspective view showing an embodiment of the ink jet printer according to the present invention.
Figure 2A:
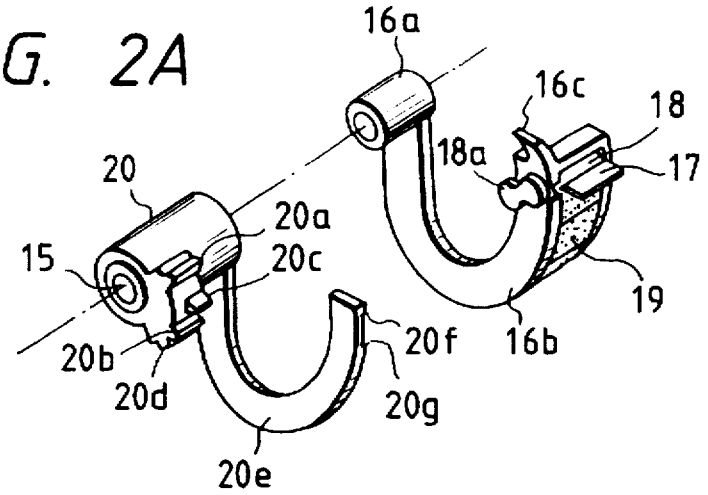
FIGS. 2A–2C are partial perspective views showing an embodiment of the blade and the ink carrier portion for the recording head.
Figure 2B:
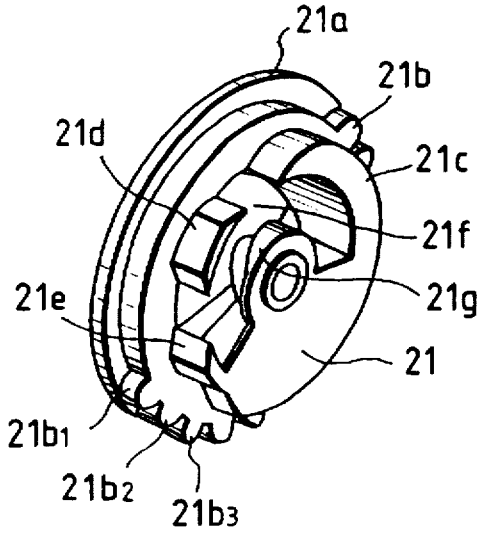
Figure 2C:
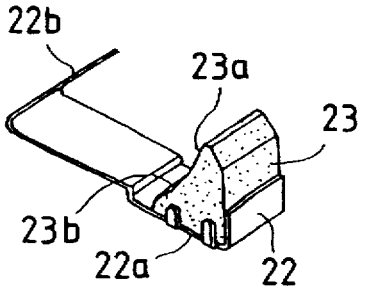
Figure 3:
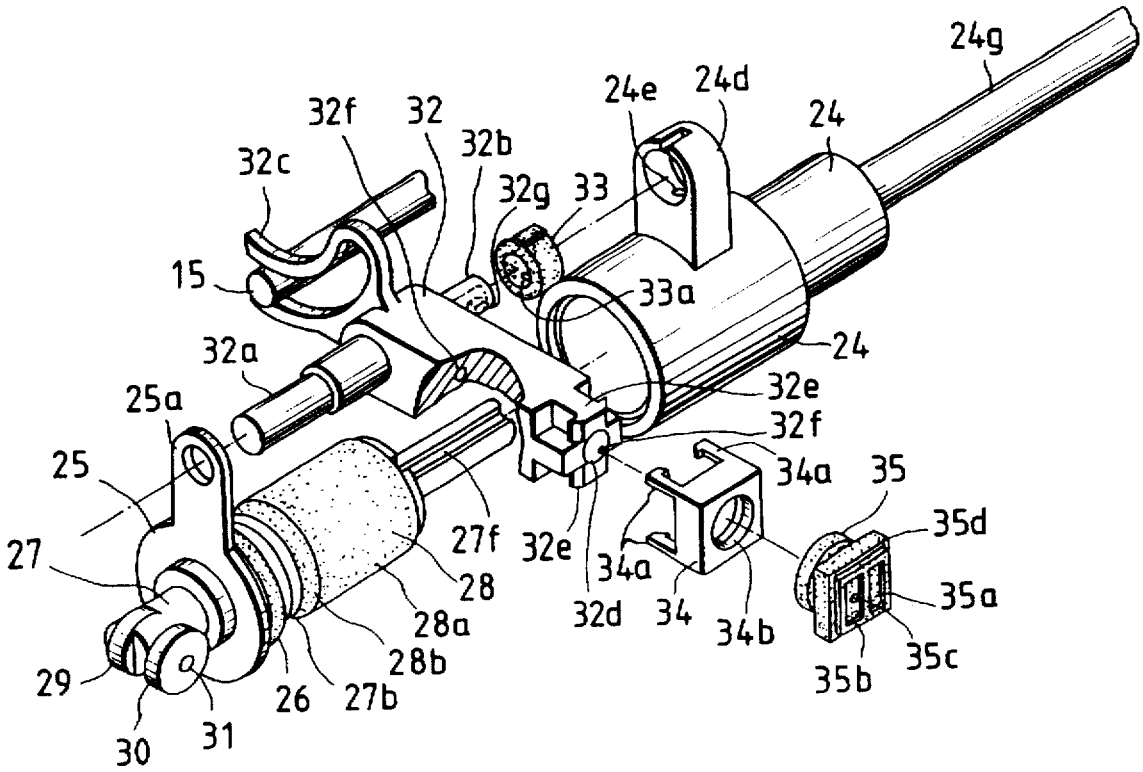
FIG. 3 and FIG. 4 are respectively an exploded perspective view and a sectional view showing an example of the suction recovery system for the recording head.
Figure 4:
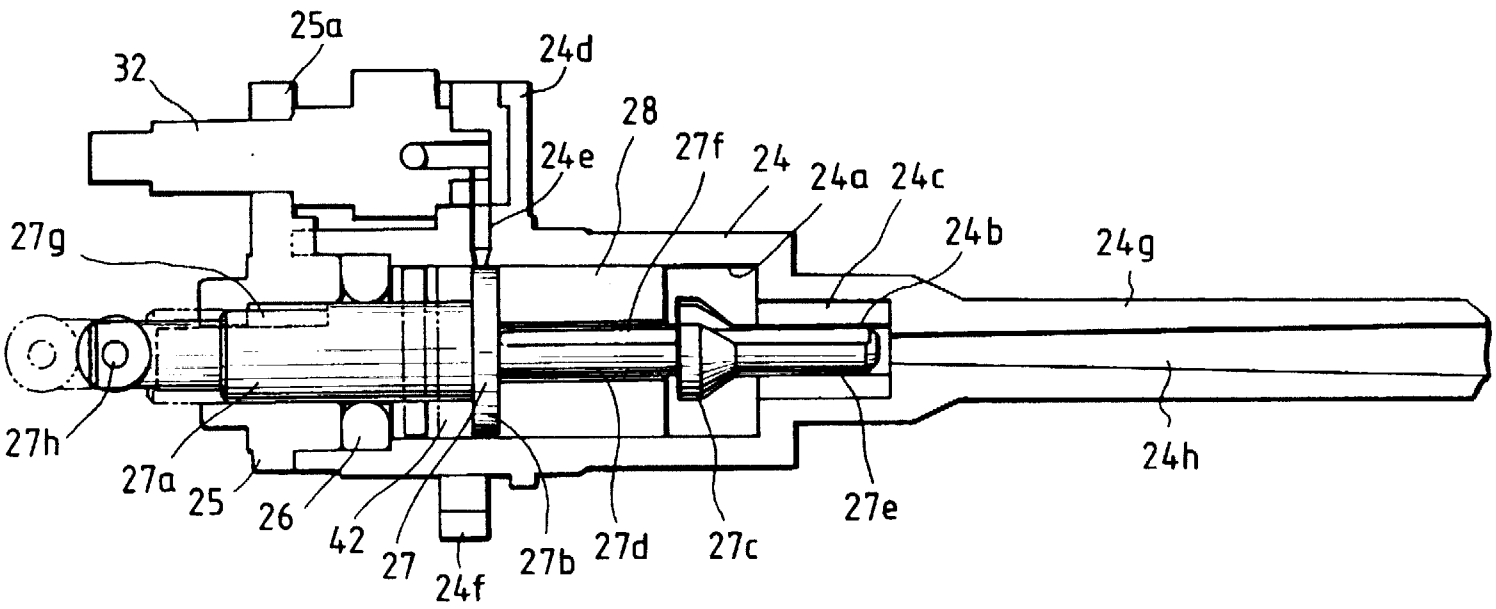

FIG. 1 is a perspective view showing the whole of a liquid injection recording apparatus (an ink jet printer) according to an embodiment of the present invention, FIGS. 2A–2C are fragmentary perspective views for illustrating various portions of means for cleaning the discharge opening forming surface of a recording head disposed in the printer, FIG. 3 is an exploded perspective view of a recovery system, and FIG. 4 is a cross-sectional view of the pump unit thereof.

Referring first to FIG. 1, the reference numeral 1 designates a chassis, and a left side plate 1*a* and a right side plate 1*b* which serve also as guides for a recording medium such as paper are provided upright on the inner part of the chassis 1. Also, a front side plate 1*c* is provided upright on the right end portion of the chassis 1, and a carrier guide plate 1*d* is provided upright on this side of the chassis. The reference character 1*e* denotes an elongate slot for guiding a carrier, and a carrier guide roller which will be described later is slidably fitted in the slot 1*e*. Although not shown, a motor mounting hole for rotatably supporting a carrier motor which will be described later is formed in the chassis 1.

The reference character 1*h* designates a lead arm for axially and radially supporting a lead screw which will be described later. The lead arm 1*h* is supported by a bearing portion (not shown).

The reference numeral 2 denotes a lead screw formed with a lead groove 2*a* at a predetermined pitch relative to the recording range. On the carrier home position side of the lead screw 2, a cap position setting cap groove 3*b* and a recovery position setting pump groove 3*c* are formed along the periphery of a cross-section perpendicular to the axis of the lead screw, and these cap groove 3*b* and pump groove 3*c* are smoothly connected together by a connecting groove 3*d*. Further, the lead groove 2*a* and the cap groove 3*b* are also smoothly connected together by an introduction groove 3*e*.

A shaft 2*g* is provided at the right end of the lead screw 2 and a shaft is also provided at the left end of the lead screw, and these shafts are fitted in bearing portions provided on the front side plate 1*c* and the lead arm 1*b*, respectively, and are rotatably supported relative thereto. The reference numeral 3 designates a lead pulley including said grooves 3*b*–3*e* and provided on the shaft of the lead screw 2. The lead pulley 3 has a pulley 3*a* at one end thereof. A drive force is transmitted from a motor 11 to the pulley 3*a* through a timing belt 13. The right end shaft 2*g* of the lead screw 2 is urged in the thrust direction by a leaf spring or the like, not shown.

The reference numeral 4 denotes a clutch gear supported for axial sliding movement on the lead pulley 3 and engaged by a key not shown, in the direction of rotation so that the rotational force of the lead screw 2 may be transmitted to the clutch gear. The reference numeral 5 designates a clutch spring which is a compression spring for biasing the clutch gear 4 toward the lead groove. Although not shown, a controlling member for permitting the clutch gear 4 moving only within a predetermined range is provided between the clutch gear 4 and the lead pulley 3.

The reference numeral 6 denotes a carrier slidably mounted on the lead screw 2. The reference character 6*a* designates a pressing portion for pressing the end surface of the clutch gear 4. The pressing portion 6*a* is formed integrally with the carrier on the left side thereof. The reference character 6*b* denotes a detecting piece for detecting the home position of the carrier 6. The reference numeral 7 designates a lead pin engaged with the lead groove 2*a* of the lead screw 2 and adapted to be guided by a guide hole (not shown) in the carrier 6. The reference numeral 8 denotes a lead pin spring having one end thereof mounted on the carrier 6 and having the other end for pressing the lead pin 7.

The reference numeral 9 designates a recording head carried on the carrier 6. In the present embodiment, the recording head 9 is in the form of a cartridge comprising, as a unit, a head element 9*a* for effecting ink discharge and an ink tank 9*b* as an ink supply source, and removably mountable on the carrier 6, and is of the disposable type which is replaceable after the ink is consumed. As a discharge energy generating element disposed in the head element 9*a* for causing discharge energy to act on the ink, use may be made of an electro-thermal converting member or an electro-mechanical converting member, but the former is preferable because of its possibility of making ink discharge openings highly dense and the simplicity of its manufacturing process.

The reference numeral 10 denotes a carrier roller rotatably mounted on the rear end surface of the carrier 6 and rotatably engaged with the aforementioned elongate slot 1*e* in the chassis 1.

The reference numeral 11 designates a carrier motor comprising, for example, a pulse motor, and having rotatable pins 11*a* provided in aligned relationship with each other on the lower portions of the front and rear surfaces thereof. These rotatable pins 11*a* (the one on the rear surface being not shown) are rotatably mounted in a motor mounting hole formed in the chassis 1. The carrier motor 11 is mounted for rotation about the rotatable pins 11*a*. The reference numeral 11*b* denotes a spring receiver formed integrally with the carrier motor 11 and provided upright and parallel to the motor shaft to receive a motor spring 14 which will be described later. The spring receiver is formed with a cylindrical projection to which is fixed one end of the coil-like motor spring 14.

The reference numeral 12 designates a motor pulley secured to the motor shaft of the carrier motor 11. The reference numeral 13 denotes a timing belt passed over and between the motor pulley 12 and the pulley 3*a* provided on the shaft of the lead screw 2. In the construction of the present embodiment, the motor spring 14 is a compression spring mounted between one end of the lead arm 1*h* and the spring receiver 11*b* of the carrier motor 11, whereby tension is imparted to the timing belt 13 if the carrier motor 11 is biased by the motor spring so as to be rotated in the direction of arrow A in FIG. 1.

The reference numeral 15 denotes a set shaft provided upright on the left side plate 1*a* and the having mounted thereon means for cleaning the discharge opening forming surface good, a cap and a mechanism concerned in discharge recovery.

The means for cleaning the discharge opening forming surface will now be described with reference to FIGS. 1 and 2A–2C.

The reference numeral 16 designates a blade lever (see FIG. 2A), and a boss portion 16*a* is rotatably mounted on the set shaft 15. The reference character 16*b* denotes an arm portion, and the reference character 16*c* designates a hook portion. The reference numeral 17 designates a blade for wiping the discharge opening forming surface. The blade 17 can be formed of an elastic material such as silicone rubber or chloroprene (CR) rubber. The reference numeral 18 denotes a blade shaft which clamps the blade 17 in the central portion thereof parallel to a rotary shaft and which is rotatably mounted on the blade lever 16. The reference 18*a* designates a pivotable piece formed integrally with the blade shaft 18. The reference numeral 19 denotes an ink carrier formed of a hydrophilic porous material (such as sintered plastic material or urethane foam) and fixed to the blade lever 16. The blade 17 and the ink carrier 19 are disposed at a position whereat they overlap a cap which will be described later.

The reference numeral 20 designates a set lever pivotally mounted on the set shaft 15. The reference characters 20*a* and 20*b* denote stop teeth provided on the set lever 20, the reference character 20*c* denotes a start tooth, and the reference character 20*d* designates a pivotable tooth. The thickness of the start tooth 20*c* is about one half of the thickness of the other teeth. The reference character 20*e* denotes an arm portion having a part thereof cut away in the direction of plate thickness to thereby form a set surface 20*f* and a reset surface 20*g* to which the pivotable piece 18*a* of the blade shaft 18 mounted on the blade lever 16 may be fitted to drive the arm portion.

The reference numeral 21 designates a timing gear rotatably mounted on the chassis 1.

The timing gear 21, as shown in FIG. 2B, is formed with a stop cam 21*a* on a portion of the outer periphery thereof for engaging the stop teeth 20*a* and 20*b* of the above-described set lever 20. The timing gear 21 is also formed with partly cut-away driving teeth $21b_1$, $21b_2$, . . . , and is further formed with cap cams 21*c*–21*e* at predetermined locations for pivotally moving a cap lever which will be described later. In addition, the timing gear 21 is formed with a piston set cam 21*f* as a face cam for pressing the piston of a pump which will be described later, and is also formed with a piston reset cam 21*g* at a predetermined interval correspondingly to the piston set cam 21*f*.

The reference numeral 22 denotes an ink absorber spring fixed to the chassis 1 at a predetermined location thereon, and having an absorber holding portion 22*a* and a spring portion 22*b* for rotating the pump which will be described later, as shown in FIG. 2C. The reference numeral 23 designates an ink absorber formed of a hydrophilic porous material, like the aforedescribed ink carrier 19. This ink absorber 23 is formed with a wiping portion 23*a* against which the aforedescribed blade 17 bears, and is further formed in the lower portion thereof with an absorbing surface 23*b* against which the aforedescribed ink carrier 19 bears to effect delivery of ink. The absorber holding portion of the ink absorber spring 22 is biased upwardly with some resilient force, and is restrained at a predetermined position by a stopper, not shown. Therefore, when the aforedescribed ink carrier 19 bears against the ink absorber 23, the ink absorber 23 flexes the ink absorber spring 22 and is displaced downwardly, whereby the bearing state may be secured.

A recovery system unit will now be described with reference chiefly to FIGS. 3 and 4.

In FIGS. 3 and 4, the reference numeral 24 designates a cylinder having a cylindrical cylinder portion 24*a* and a guide portion 24*b* for guiding a piston shaft which will be described later, the guide portion 24*b* being partly cut away axially thereof to thereby form an ink flow path 24*c*. The reference character 24*d* denotes a cap lever receiver formed so as to receive a lever seal which will be described later. The reference character 24*e* designates an ink flow path which opens at a predetermined location in the cylinder portion 24*a*. The reference character 24*f* denotes a pivotable lever formed integrally with the cylinder 24 and adapted to be given a pivoting force by the spring portion 22*b* of the aforedescribed ink absorber spring 22. The reference character 24*g* designates a waste ink tube formed integrally with the cylinder 24 and having its end portion cut an acute angle so that it may be readily inserted into a waste ink absorber which will be described later. The reference character 24*b* denotes an ink flow path formed in the waste ink tube 24*g*.

The reference numeral 25 designates a cylinder cap which is forced into the end portion of the cylinder 24. The reference character 25*a* denotes a lever guide disposed at a location opposed to the cap lever receiver 24*d* of the aforedescribed cylinder 24.

The reference numeral 26 designates a piston seal fitted in the cylinder 24 and having its inner diameter made somewhat small so that a predetermined pressure contact force may be provided with respect to a piston shaft which will be described later. Also, the surface of the piston seal may be lubricant-coated to as to reduce the sliding force of the piston shaft.

The reference numeral 27 denotes a piston shaft formed with an operative shaft 27*a*, a piston keeper 27*b*, a piston receiver 27*c*, a connecting shaft 27*d* and a guide shaft 27*e*, and further formed with a groove 27*f* as an ink flow path along the connecting shaft 27*d* and the guide shaft 27*e*. The reference character 27*g* designates a keyway formed as a groove in the operative shaft 27*a*. A bearing portion 27*b* is provided on the end surface of the operative shaft 27*a*.

The reference numeral 28 denotes a piston. The body of the piston 28 which forms an inner layer as viewed from the cylinder sliding portion side is formed of an elastic porous material. As this material, mention may be made of a foamed material (such as sponge) having single-foamed pores or a porous material having continuous pores such as a continuous minute porous material, and preferably the latter, for example, urethane foam which is communication-foamed. Use may also be made of a material in which a plurality of continuous pores exist in a direction intersecting the direction of elastic deformation. The outer diameter of the piston is increased by a predetermined amount than the inner diameter of the cylinder 24, and when the piston is inserted into the cylinder 24, the piston becomes moderately compressed. Also, the outer peripheral surface 28*a* of the piston 28 and the end surface 28*b* of the piston which bears against the piston keeper 27*b* of the piston shaft 27 are adapted to position a solid layer (a skin film) thereat during the foam formation of the piston. Here, even if the material forming the piston body is communication-foamed, the skin film does not liquid-communicate and air-tightness is kept and thus, the piston 28 performs that function. If use is made of a material having no skin film, a coating for keeping air-tightness may be provided separately.

The reference numeral 42 designates a pump chamber. The reference numeral 29 denotes a piston pressing roller rotatably mounted on the end portion of the piston shaft 27. The reference numeral 30 designates a piston return roller also rotatably mounted on the end portion of the piston shaft 27. The reference numeral 31 denotes the shaft of these rollers.

The reference numeral 32 designates a cap lever formed with a rotary shaft 32*a*, an ink guide 32*b* and a lever guide 32*c*. A convex spherically-shaped seal surface 32*d* is formed on the tip end portion of the cap lever. Also, engagement portions 32*e* adapted to be engaged by the pawl of a cap holder which will be described later are provided as a pair of upper and lower members. Further, an ink flow path 32*f* passes from the seal surface 32*d* through the interior of the lever, bends halfway at right angles, passes through the center of the ink guide 32*b* and opens to the end surface thereof. A cut-away 32*g* is formed in the lower portion of the ink guide 32*b*.

The reference numeral 33 denotes a lever seal in which the ink guide 32*b* is fitted and which is forced into the cap lever receiver 24*d*. The reference character 33*a* designates a communication hole which communicates the cut-away 32*g* of the ink guide 32*b* with the ink flow path 24*e*.

The reference numeral 34 designates a cap holder formed with a hook 34*a* at a location opposed to the engagement portion 32*e* of the cap lever 32 for engaging the engagement portions 32*e*. The reference character 34*b* denotes an opening for mounting a cap which will be described later.

The reference numeral 35 denotes a cap formed with a hermetically sealing cap 35*a* for preventing the ordinary desiccation of ink, and also formed with a suction cap 35*b* adjacent thereto. A suction opening 35*c* is formed in the suction cap 35*b*, and bends the ink flow path in the cap and opens toward the cap holder 34 through the central portion thereof.

The reference character 35*d* designates a flange portion which serves as slip-off preventing means when the cap is mounted on the cap holder 34. The flange portion 35*d* is formed with a concave spherically-shaped cap seal portion 35*e* having the same curvature as that of the seal surface 32*d* of the cap lever 32, and is designed such that when it is urged against the cap lever 32, only the central opening thereof communicates and the other portions thereof are sealed. The seal portions (32*d*, 35*e*) are spherically-shaped and therefore are excellent in the equalizing function for the cap member, and even where there is a level difference in the discharge opening forming surface (see FIGS. 24B and 24C), they can absorb the level difference on the spot to thereby keep a stable hermetically sealed state.

Now, referring again to FIG. 1, the reference numeral 36 designates a paper feeding roller for conveying a recording medium such as paper. The paper feeding roller 36 can be formed as by applying an elastic coating material (such as urethane resin) to the surface of a drawn tube of aluminum. Also, this roller 36 in its outer surface functions as a platen for controlling the recording surface of the recording medium, and the interior thereof is used as a reservoir for waste ink. The reference numeral 37 denotes a waste ink absorbing portion provided within the roller 36. The waste ink absorbing portion 37 is of a construction in which a thin tube formed of a plastic material such as vinyl chloride is filled with an absorbing material such as polyester cotton so as to ensure good axial absorption of ink. The waste ink tube 24*g* of the cylinder 24 is inserted in the waste ink absorbing portion 37 and fixed thereto. The fiber itself of the absorbing material may preferably be a non-liquid-absorbing material such as resin or a metal, but may slightly have a liquid-absorbing property.

The reference numeral 38 designates a paper keep plate attached to the chassis 1. The reference numeral 39 denotes a paper feeding motor connected to the paper feeding roller 36 through a reduction gear mechanism of predetermined ratio.

The reference numeral 40 designates a recording medium such as paper or film.

The reference numeral 41 denotes a detector for detecting the home position of the carrier. In the present embodiment, the detector 41 is comprised of a transmission type photo-interrupter. That is, the detecting piece 6*b* of the carrier 6 can interrupt the optical path to thereby detect the position of the carrier.

The operation of the above-described construction will now be described.

First, during the ordinary recording operation, the lead screw 2 is rotated by the rotation of the shaft of the carrier motor 11 through the timing belt 13 and therefore, the carrier 6 is scanned in the print column direction along the recording medium 40 by the lead pin 7 engaged with the lead groove 2*a*. Here, the carrier motor 11 is biased by the motor spring 14 and therefore, the timing belt 13 is always tensioned and good transmission is accomplished.

An inertia force acts when the carrier 6 is started and stopped, but the weight of the carrier motor 11 provides inertia and therefore, the load of the motor spring 14 may be small and the load of the motor may also be small. Also, if an air damper, a hydraulic damper or the like is provided in connection with this spring, the noise by the vibration of the rotor of the motor 11 can be reduced when the carrier 6 is started and stopped. If the weight of this motor, the weight of the carrier portion and the coefficient of the motor spring damper are chosen appropriately, the overshoot of the rotor can be reduced and low noise can be accomplished.

Figure 5:
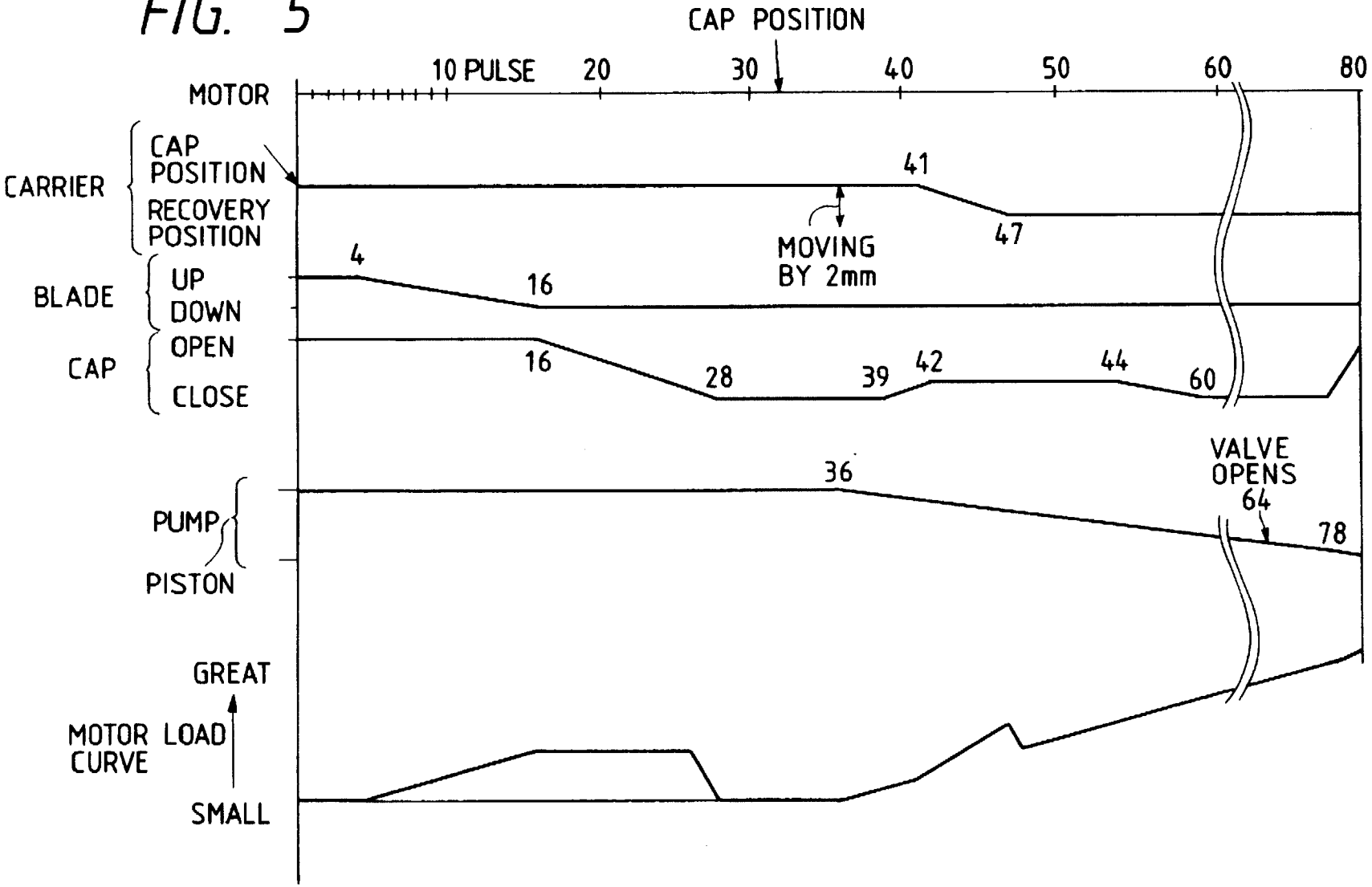
FIG. 5 is a timing chart showing the actuation timings of the respective parts according to an embodiment of the invention.
Figure 6A:
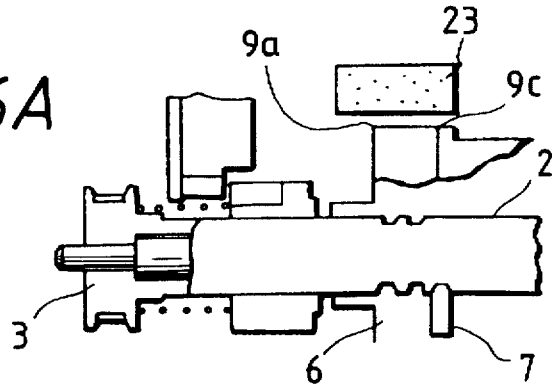
FIGS. 6A–6C are plan views for illustration of the positional relationships between the recording head during preliminary discharging, capping and suction recovery and the members provided for those treatments.
Figure 6B:
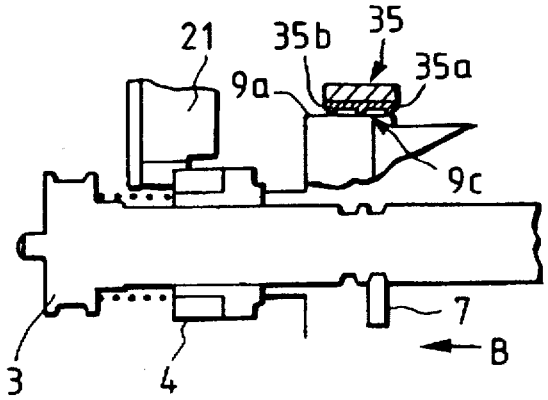
Figure 6C:
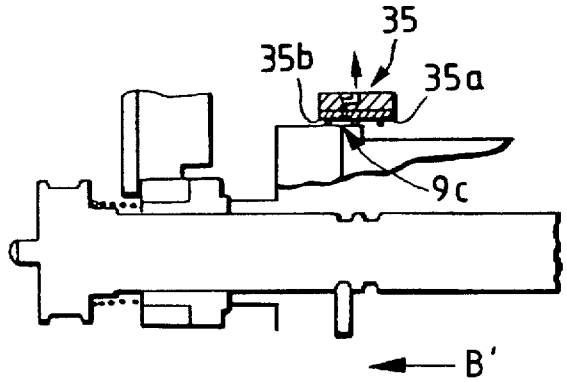
Figure 7A:
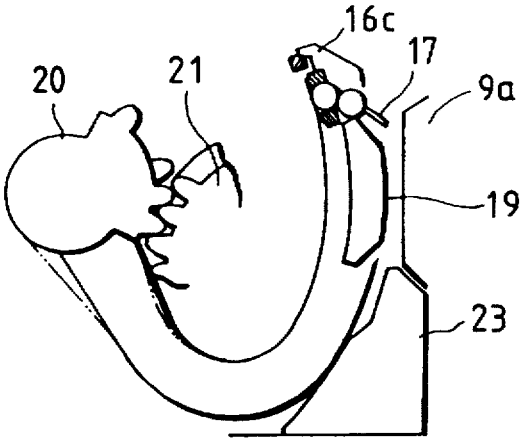
FIGS. 7A–7D are side sectional views for illustration of the successive actuations of the ink carrier portion.
Figure 7B:
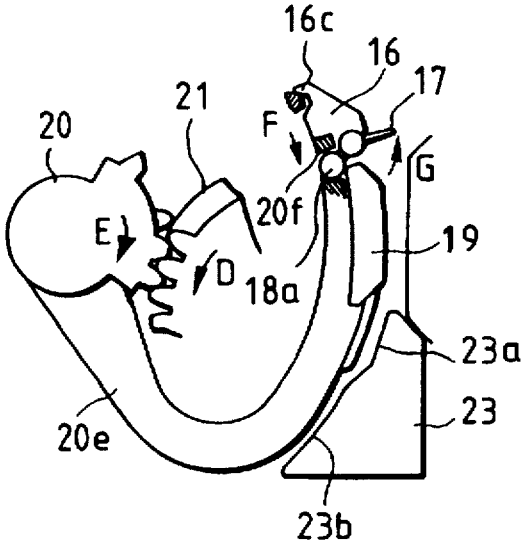
Figure 8A:
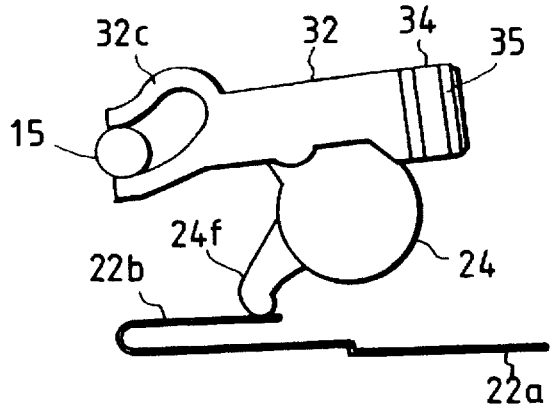
FIGS. 8A–8C are side sectional views for illustration of the successive actuations of the cap portion.
Figure 8B:
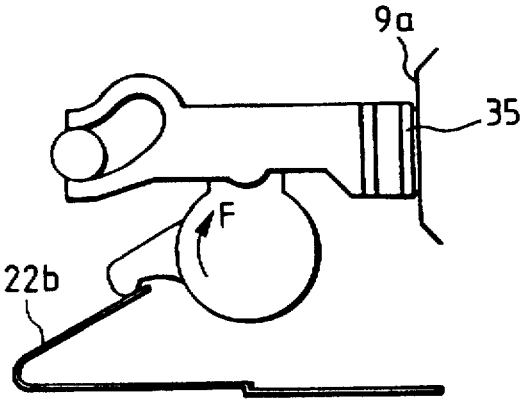
Figure 8C:
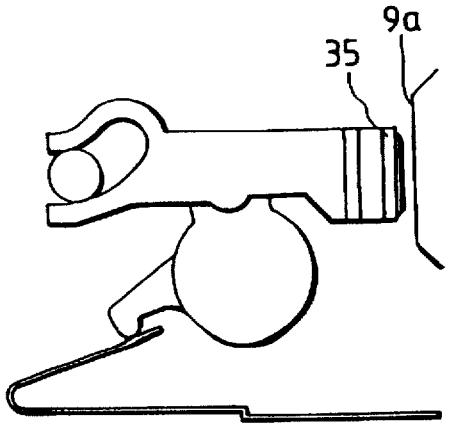
Figure 9A:
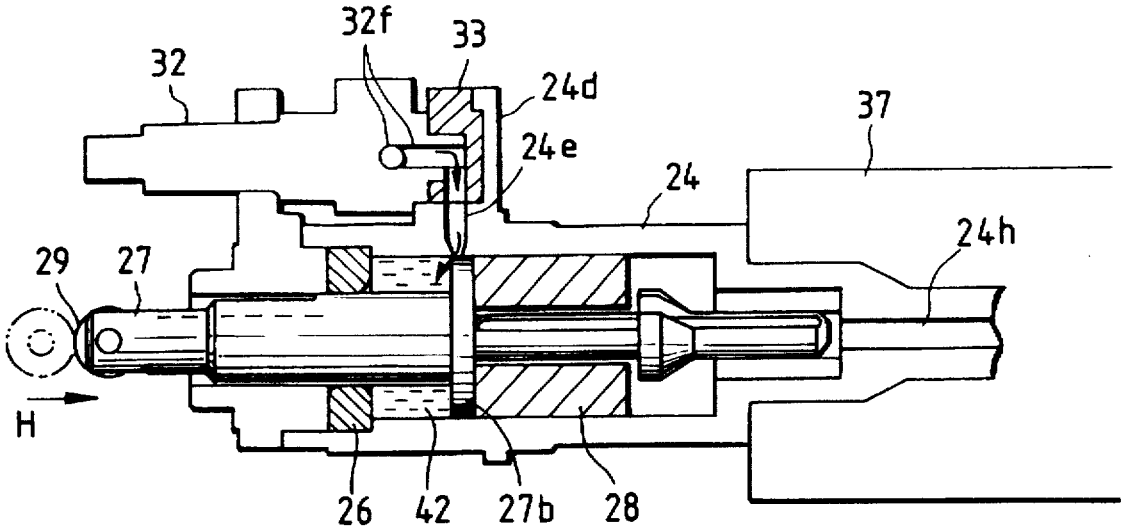
FIGS. 9A and 9B are side sectional views for illustration of the actuations of performing suction recovery.
Figure 9B:
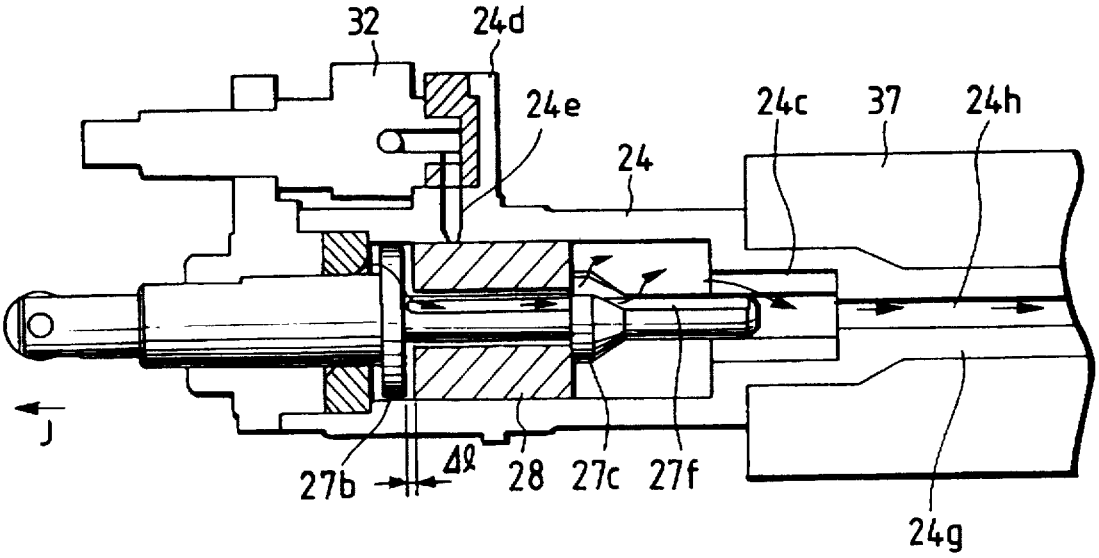

The operation of the present embodiment during non-recording will now be described with reference to FIGS. 5 to 9. FIG. 5 is a timing chart showing the operation timing of each portion, and the operation timing of each portion as shown can be determined by a pulse number imparted to the motor 11. FIGS. 6A–6C illustrate the successive operating conditions of each portion lying near the home position, FIGS. 7A–7D illustrate the successive operating conditions of a mechanism concerned in the blade 17, etc., FIGS. 8A–8C illustrate the successive operating conditions of a mechanism concerned in the cap 35, and FIGS. 9A and 9B illustrate the operation of a mechanism for introducing the waste ink into the waste ink containing portion 37 within the roller 36.

The carrier 6 is first moved toward the home position (in the direction of arrow B), and detection is effected by the home position detector 41 (this position may be made coincident with the start position during the lap-up of recording). At this time, as shown in FIG. 6A, the lead pin 7 is in engagement with the lead groove 2*a* and the discharge opening 9*c* of the head element 9*a* is in a position opposed to the ink carrier 19 (see FIG. 7A). In this position, all of the discharge energy generating elements of the head element 9*a* are driven to effect the discharge operation (hereinafter referred to as the preliminary discharge), and the ink somewhat increased in viscosity is discharged by that discharging force, and the recovery operation by this preliminary discharge can be terminated. The preliminary discharge to be periodically effected to prevent the ink in the unused discharge opening from being increased in viscosity in the course of ordinary recording is also effected in this position. FIG. 7A is a side view showing the vicinity of the same position.

Further, when as shown in FIG. 6B, the lead screw 2 is rotated to move the carrier 6 in the direction of arrow B, the clutch gear 4 is pressed by the pressing portion 6*a* and moved in the same direction B, and comes into meshing engagement with the driving tooth 21*b* of the timing gear 21. The clutch gear 4 is rotated in synchronism with the lead screw 2 and therefore, as the motor 11 is driven, the timing gear 21 is rotated in the direction of arrow D as shown in FIG. 7B. On the other hand, the lead pin 7 comes from the introduction groove 3*e* into the cap groove 3*c* and therefore, the carrier 6 will not be moved even if the lead screw 2 is rotated.

As the timing gear 21 is rotated in the direction of arrow D, the set lever 20 begins to pivot in the direction of arrow E because the gear portion of the timing gear is in meshing engagement with the gear portion of the set lever 20. Since until this time, the blade lever 16 has its hook portion 16*c* engaged with the pawl portion of the chassis, only the set lever 20 is rotated and the blade lever 16 is stopped, but soon the set surface 20*f* of the set lever 20 pivots in the direction of arrow F while depressing the pivotable piece 18*a* of the blade shaft 18 and therefore, the blade 17 is rotated in the direction of arrow G and set in a state in which it is engageable with the discharge opening forming surface.

Figure 7C:
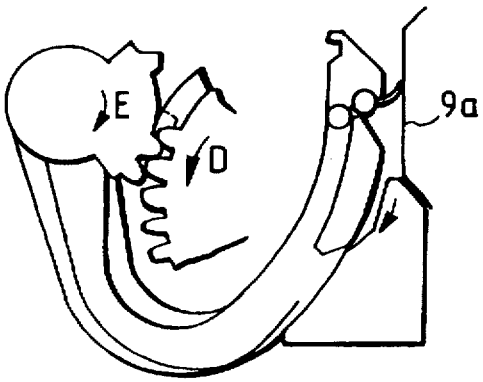
Figure 7D:
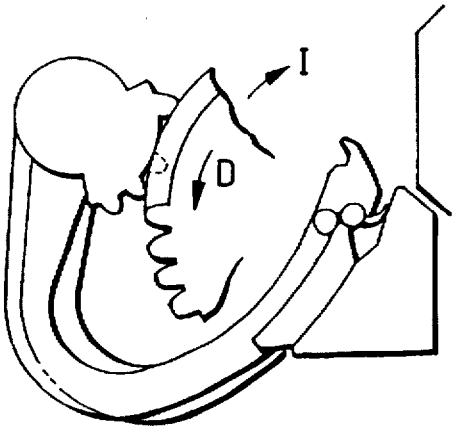

As the timing gear 21 is further rotated in the direction of arrow D, the set lever 20 and the blade lever 16 also are further rotated to thereby wipe the discharge opening forming surface of the head 9 as shown in FIG. 7C. At this time, the ink liquid, etc. removed by the blade 17 are eliminated only in one direction, i.e., only downwardly in this case, and the ink liquid, etc. thus eliminated is absorbed or retained in the upper portion of the ink carrier 19. Also at this time, the ink carrier 19 begins to contact with the ink absorber 23. When the set lever 20 is further rotated, as shown in FIG. 7D, the ink carrier 19 and the blade 17 slide relative to the surface of the wiping portion 23*a* of the ink absorber 23 and therefore, the ink received by the ink carrier 19 during the preliminary discharge and dust or the like wiped off from the discharge opening forming surface by the blade 17 are received by the wiping portion 23*a* and ink droplets adhering to the discharge opening forming surface are also absorbed. Thus, the ink carrier 19 can maintain its ink absorbing ability for a long period of time.

The timing gear 21 is further rotated in the direction of arrow D, but since the stop teeth 20*a* and 20*b* of the set lever 20 contact with the stop cam 21*a* of the timing gear 21 in opposed relationship with each other, the rotation of the timing gear is restricted and at the same time, any force rotating the timing gear does not act because the driving tooth of the timing gear 21 then corresponds to a cut-away portion.

As described above, the blade and the absorber for retaining the ink liquid, etc. removed by the blade are identical to the ink receiver used during the preliminary discharge and therefore, the apparatus can be made compact and the time for the recovery operation can be shortened.

When the timing gear 21 is further rotated, as shown in FIG. 8A, the cap 35 is stopped at a position far from the discharge opening forming surface of the head element 9*a* because initially, the cap cam 21*c* controls the rotary shaft 32*a* of the cap lever 32*c*. Next, when the timing gear 21 is further rotated in the direction of arrow D, the cap comes off the cap cam 21*c* and therefore, the controlled state is released and thus, as shown in FIG. 8B, the pivotable lever 24*f* of the cylinder 24 is biased by the spring portion 22*b* of the ink absorber spring 22 and the cylinder 24 is rotated in the direction of arrow F, and the hermetically sealing cap 35*a* of the cap 35 is urged against the discharge opening forming surface, thus terminating the capping operation. FIG. 6B shows the then top plan view. At this time, the seal surface 32*d* and the cap seal portion 35*e* are also brought into intimate contact with each other by the pressing force of the cap and sealing is accomplished.

Now, what has been described above is the wiping and capping operations for the nozzle surface and usually, the apparatus is stopped from operation here and the above-described operation is reversely performed in conformity with the inputting of the next recording signal, and the recording operation is entered.

Description will now be made of the suction recovery operation performed as when the discharge condition does not become sufficient even by the preliminary discharge.

When this operation is to be started, the timing gear 21 is further rotated from the cap position, and the cap lever 32 is pressed by the cap cam 21*b* to thereby space the cap 35 apart from the discharge opening forming surface as shown in FIG. 8C.

The lead pin 7 then passes through the connecting groove 3*d* and shifts to the pump groove 3*c* and therefore, the carrier 6 is moved in the direction of arrow B by a predetermined amount (the distance between the cap groove and the pump groove).

When the timing gear 21 is further rotated in the direction of arrow D, the cap again comes off the cap cam 21*d* and therefore, the cap 35 comes into pressure contact with the discharge opening forming surface. Since at this time, the recording head 9 has been moved, the discharge opening forming surface is capped by the suction cap 35*b* (see FIG. 6C).

In the present embodiment, as shown in FIG. 6, the discharge opening 9*c* is biased toward the recording area side relative to the discharge opening forming surface, and during ordinary capping which does not involve suction, as shown in FIG. 6B, the whole surface of the cap 35 is completely opposed to the discharge opening forming surface and therefore, the pressure against each rib portion of the cap decreases. At this time, however, the sealing property with respect to the outside air need only be kept and therefore, there is no hindrance to the prevention of desiccation, and the clearance can be hermetically sealed by a pressure force of the order of 10 g. Also, the collapse of the rib portions is little, and this leads to the advantage that the decrease in the volume in the cap may be slight and the retraction of ink meniscus during the capping does not occur.

Further, as regards the capping during the recovery process, the cap portion usually comes off the discharge opening forming surface as shown in FIG. 6C and therefore, pressure is applied to only the rib portion of the cap for recovery, and the sealing property is improved and thus, the prevention of leakage by negative pressure becomes reliable. Even if at this time, meniscus is retracted by a decrease in the volume in the cap caused by the cap, meniscus is returned by the suction operation and therefore, no problem arises.

Now, describing the pump operation, the suction operation is entered when the recovery operation is entered after the aforedescribed sealing cap is terminated.

At this time, by the rotation of the timing gear 21, the piston set cam 21*f* first pushes the piston pressing roller 29 mounted on the piston shaft 27 and therefore, the piston shaft 27 is moved in the direction of arrow H as shown in FIG. 9A. The piston 28 is pressed and moved in the direction of arrow H by the piston keeper 27*b*, and the pump chamber 42 assumes negative pressure. Since there is a skin layer on the surface of contact between the outer periphery of the piston 28 and the piston keeper 27*b*, ink does not leak through the communication hole in the foamed material.

Also, since the ink flow path 24*e* in the cylinder 24 is closed by the piston 28, the negative pressure in the pump chamber 42 only becomes higher and the piston 28 remains movable. On the other hand, after the aforedescribed recapping, the ink flow path 24*e* opens as shown in FIG. 9A and therefore, the ink in the head 9 is sucked from the suction port 35*c* of the cap 35 as shown in FIG. 6C. The thus sucked ink passes through the ink flow path 32*f* formed within the cap lever 32, and through the communication hole in the lever seal 33 and further through the ink flow path 24*e* in the cylinder 24 into the pump chamber 42.

When the timing gear 21 is further rotated, the cap 35 again becomes somewhat spaced apart from the discharge opening forming surface by the cap cam 21*e*, and the ink in the discharge opening forming surface and the suction cap 35*b* is sucked by the residual negative pressure in the pump chamber, whereby the remaining of the ink in these portions is eliminated.

Next, when the timing gear 21 is rotated in the opposite direction (the direction indicated by arrow I in FIG. 7D), the piston reset cam 21*g* pulls the piston return roller 30 and moves the piston shaft 27 in the direction of arrow J as shown in FIG. 9B. At this time, the piston 28 is moved after it is contacted by the piston receiver 27*c* of the piston shaft 27 and therefore, a gap Δl is created between the end surface 28*b* of the piston 28 and the piston keeper 27*b*.

Thus, by the movement of the piston shaft 27 and the piston 28, the waste ink sucked into the pump chamber 42 passes through the aforementioned gap Δl and through the groove 27*f* of the piston shaft and through the ink flow path 24*c* in the cylinder 24 and further through the waste ink tube 24*g* and is discharged to the vicinity of the center of the waste ink absorber 37. At this time, the waste ink does not flow back toward the cap because at the early stage of the operation of the piston 28, the ink flow path 24*e* in the cylinder 24 is closed by the piston 28.

Figure 10:
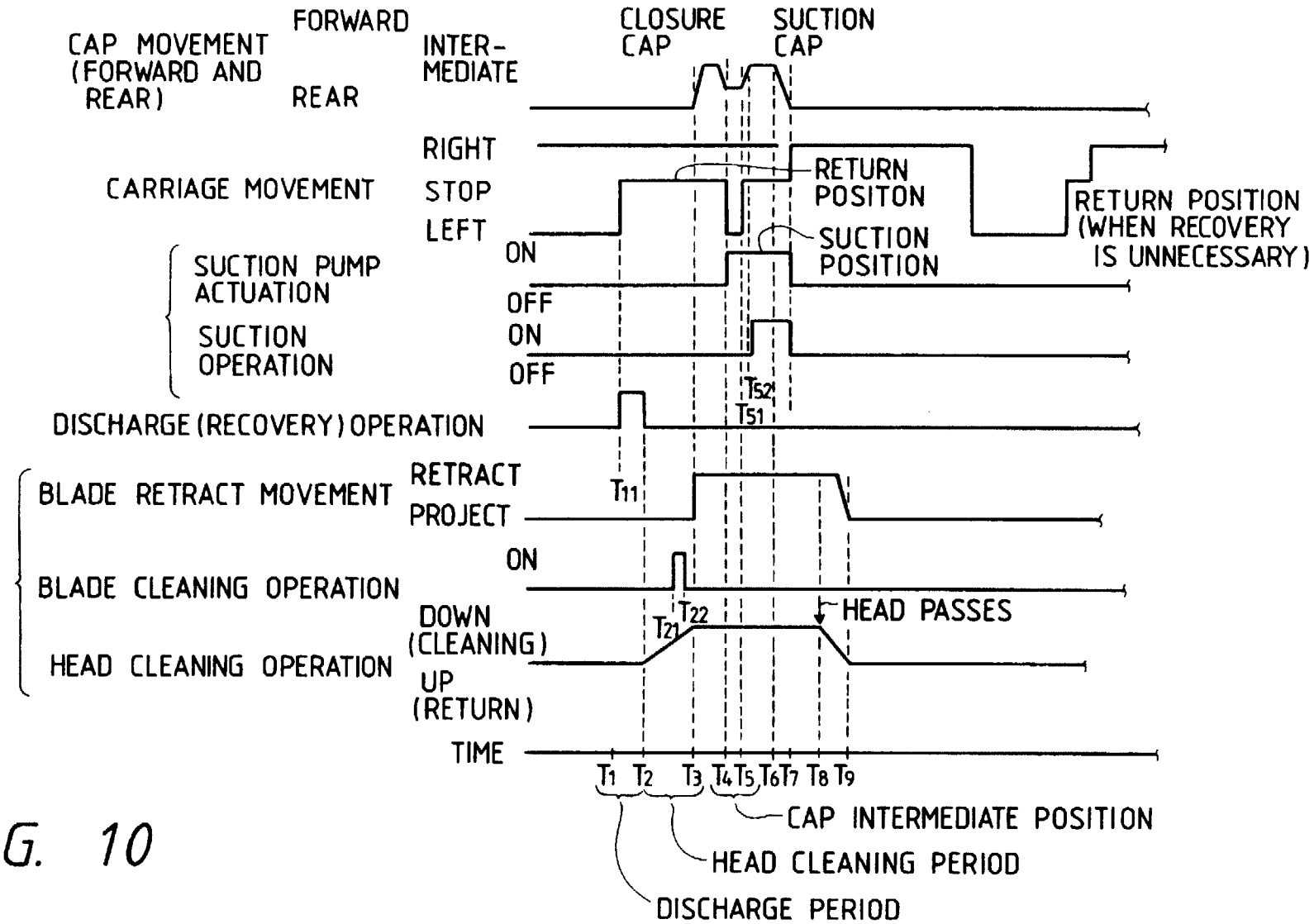
FIG. 10 is a timing chart for illustration of the sequence during preliminary discharging or suction recovery treatment according to the present embodiment (partially other embodiments)

FIG. 10 collectively shows the sequence of the above-described preliminary discharge to the suction recovery, and more particularly shows the sequence in which the blade 17 stands by in a state in which it is capable of wiping (the set state, see FIG. 7B) and after the wiping, the blade 17 becomes inclined with respect to the absorber 23 (the reset state, see FIG. 7A), whereafter the blade 17 is brought into a set state in which it is capable of wiping immediately before the set lever 20 is returned to its original position.

The present invention is not restricted to the above-described construction, but can adopt various constructions, so other embodiments of various portions will be shown below by way of example.

Figure 11:
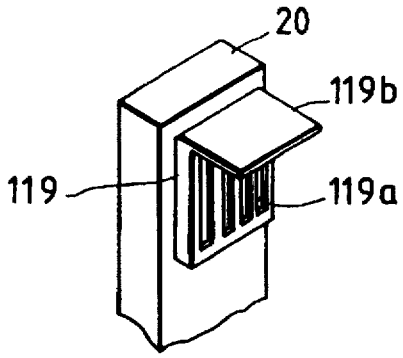
FIG. 11 and FIG. 12 are perspective views showing two other embodiments of the blade and the ink carrier portion.

FIG. 11 shows another embodiment of the blade and ink carrier portion. An ink carrier body 119 according to the present embodiment is formed of an elastic material such as rubber, and an ink receiving portion 119*a* performing the same function as the above-described ink carrier 19 is formed with a number of grooves or concavo-convexities. The ink receiving portion 119*a* retains ink by the surface tension thereof and carries the ink to the ink absorber 23. The ink carrier body 119 has formed integrally therewith a blade 119*b* for wiping the discharge opening forming surface 9*a* of the head 9. According to this, the ink carrier body 119 can be provided directly on the set lever 20 and therefore, the blade lever 16 becomes unnecessary and thus, the number of parts can be reduced to make the apparatus inexpensive.

Also, where the direction of discharge is made downward, the ink on the discharge opening forming surface when wiped by the blade 119*b* is received by the grooves or the concavo-convexities and does not flow out to other mechanism portions and thus, contamination or the like of the instrument can be prevented.

Figure 12:
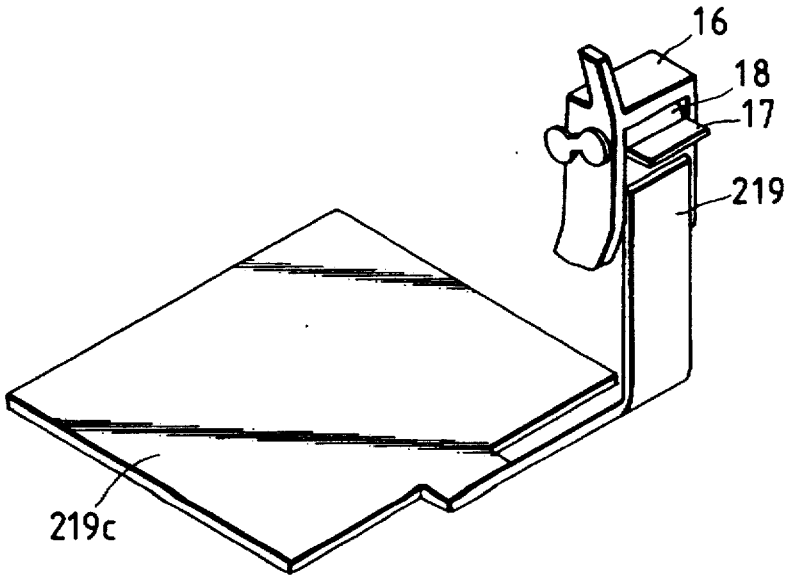

FIG. 12 shows still another embodiment of the blade and ink carrier portion. In this embodiment, an ink carrier 219 is elongated and made integral with an ink absorber 219*c*, and in this case, the material forming the ink carrier may preferably be bendable woven cloth or laminated paper.

In the present embodiment, the aforedescribed ink absorber 23 and the holding member therefor become unnecessary and moreover, it becomes possible to dispose the blade and ink carrier portion broadly in the lower portion of the chassis and therefore, this embodiment is also suitable for an instrument in which the amount of ink preliminarily discharged is great.

Figure 13:
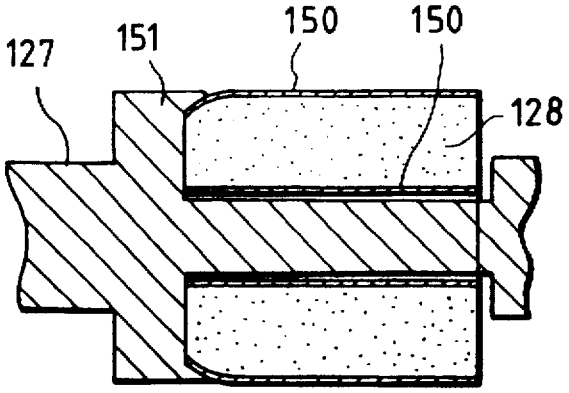
FIG. 13 and FIG. 14 are sectional views showing two other embodiments of the piston arranged at the pump portion.

FIG. 13 shows another embodiment of the piston portion. A piston 128 according to the present embodiment is designed such that a skin layer 150 is not present on the end surface thereof, and a piston keeper 127 is provided with a flange portion 151 as shown and the piston 128 is held in its squeezed state. Not only can air-tightness be kept by such a construction, but also the piston 128 can be manufactured by cutting a long piston blank and therefore, the cost thereof can be made lower.

Figure 14:
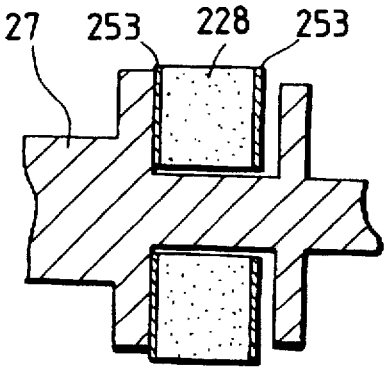

FIG. 14 shows still another embodiment of the piston portion. A piston 228 according to the present embodiment is formed by a plate-like member. Such a piston can be simply manufactured by being shielded in the direction of the thickness of a skin layer 253 and pressed and therefore, the cost of manufacture thereof can be made still lower.

Figure 15:
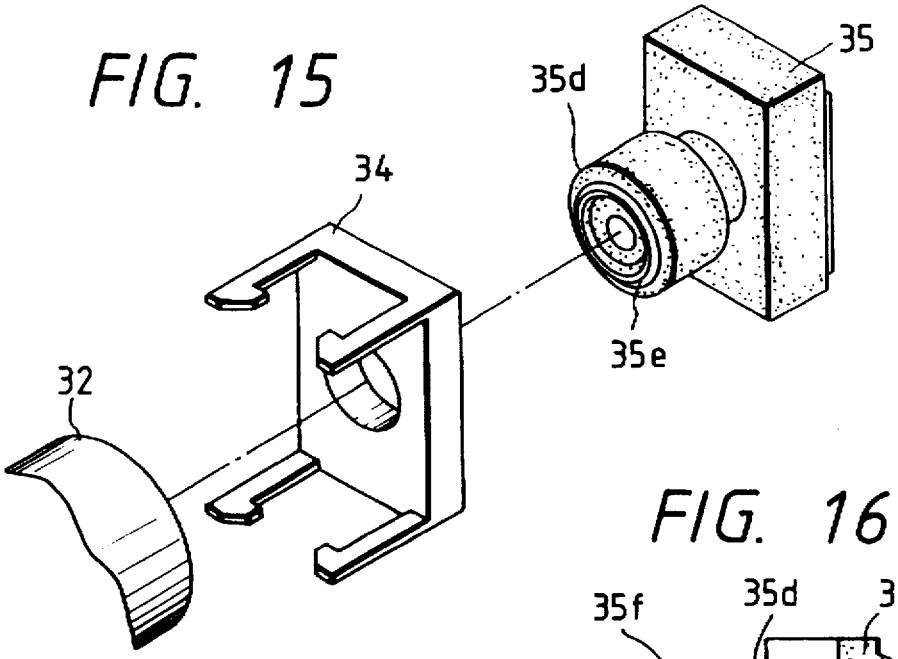
FIGS. 15 through 17 are diagrams for illustration of three other embodiments of the connecting portion in the suction recovery system behind the cap.

FIG. 15 shows another embodiment of the rear portion of the cap 35. The present embodiment is such that a rib 35*e* is provided on the seal surface 35*d* and air-tightness can be further secured by the deformation of the rib portion.

Figure 16:
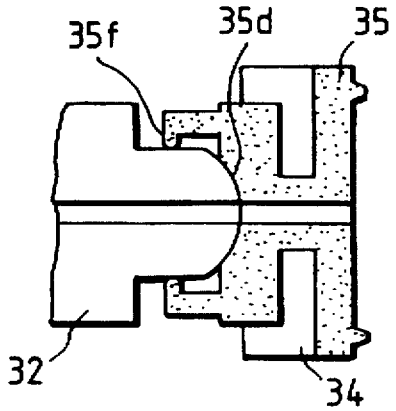

FIG. 16 shows still another embodiment of the rear portion of the cap 35. The present embodiment is provided with a spherically-shaped seal portion 35*d* and a protective seal portion 35*f* covering it. The present embodiment can prevent ink or dust from adhering to the aforedescribed spherically-shaped seal portion 35*d* when the latter is not capped, and deteriorating the sealing performance thereof.

Figure 17:
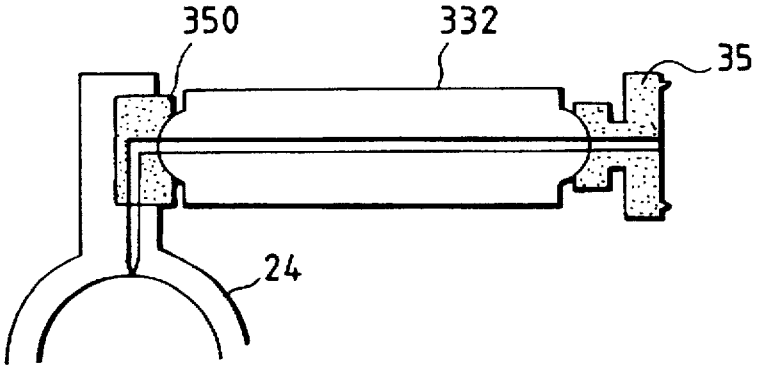

FIG. 17 shows yet still another embodiment of the rear portion of the cap 35. In the present embodiment, a spherically-shaped seal 350 is provided on the connecting portion between a cap lever 332 holding the cap 35 and the cylinder 24 of the pump, and all the seal portions of the ink flow path are pressed by the same spring force to thereby accomplish sealing. According to this, the operational force of the entire recovery system can be reduced.

Figure 18:
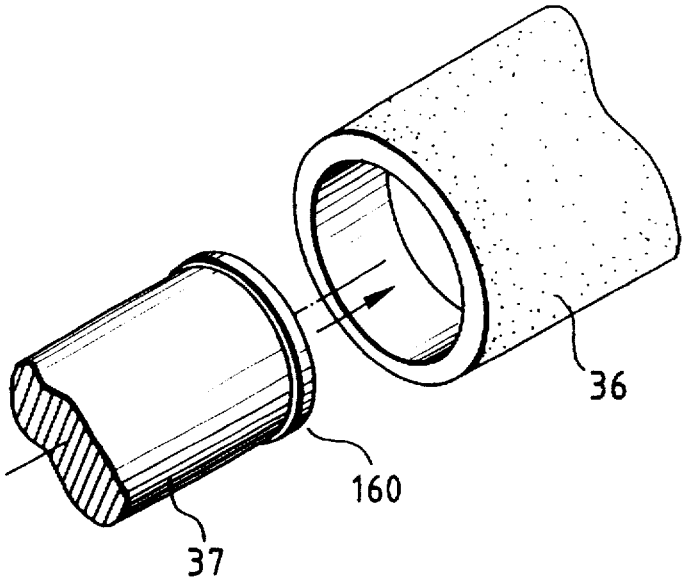
FIGS. 18 through 20 are perspective views showing three other embodiments of the waste ink absorbing portion arranged within the paper delivery roller.

FIG. 18 shows another embodiment of the waste ink containing portion disposed within the roller 36 which is conveying means. In the present embodiment, a guide member 160 is mounted on the end portion of a waste ink absorber 137. According to this, the frictional force on the inner surface of the paper feeding roller 36 can be reduced to thereby reduce the load of the paper feeding motor 39.

Figure 19:
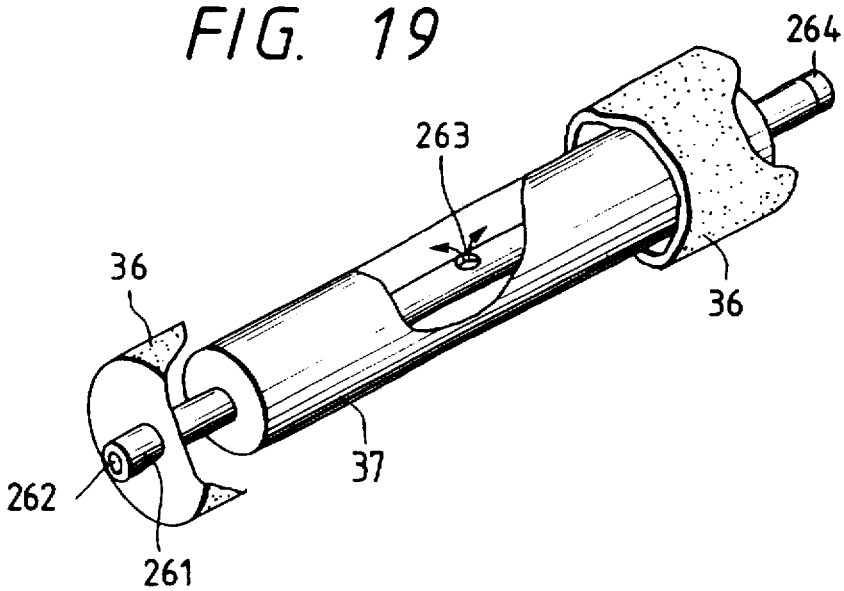

FIG. 19 shows still another embodiment of the waste ink absorbing portion. A hollow shaft 261 extends through the central portion of a waste ink absorber 237 according to the present embodiment, and openings 262 and 263 are provided in the end portion and the central portion, respectively, of the hollow shaft 261. The reference numeral 264 designates a lid.

In the present embodiment, waste ink passes through the hollow shaft 261, and the hollow shaft 261 can be endowed with a function as the guide shaft of the paper feeding roller 36. In this case, there is no sliding portion in the paper feeding roller and the load of the paper feeding motor is further reduced.

In the present embodiment, a main ink discharging portion 263 is provided in the central area of the platen roller as viewed in the lengthwise direction thereof, but a second ink discharging portion and a third ink discharging portion may be provided upstream and downstream, respectively, of the discharging portion 263 with respect to the ink guide member. Also, a construction may be adopted in which the size of the former is smaller than that of the discharging portion in the central portion and the size of the latter is larger than that of the discharging portion in the central portion.

Figure 20:
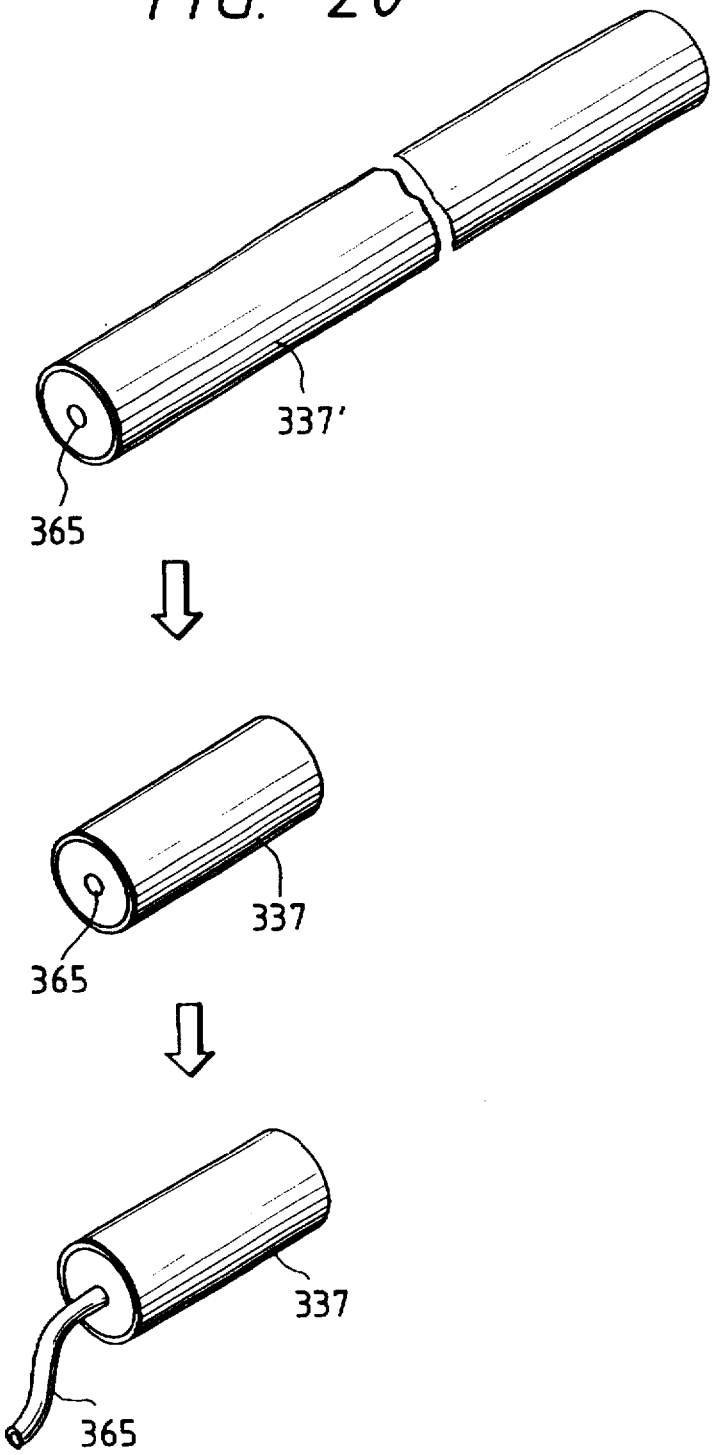

FIG. 20 shows yet still another embodiment of the waste ink absorbing portion. In the present embodiment, when a waste ink absorber 337 is to be manufactured, a tube 365 for waste ink is put into the center of a blank 337' and is cut, whereafter this tube 365 is half drawn out and connected to a pump for recovery. According to the present embodiment, the difficulty with which a member having no rigidity such as a flexible tube is inserted to the vicinity of the center can be eliminated. At this time, one half of the waste ink absorber 337 remains as the tube is drawn out, but where polyester cotton or the like is used, the waste ink absorber is sufficiently compressed and therefore the hole is closed.

The waste ink absorbing portion is provided within the roller-like conveying means as described above, and besides, can be provided at a suitable region within the conveying means depending on the construction thereof. For example, where the conveying means is constituted by a plurality of rollers and a belt passed between the rollers, the waste ink absorbing portion may be provided in the space defined by the rollers and the belt.

Figure 21:
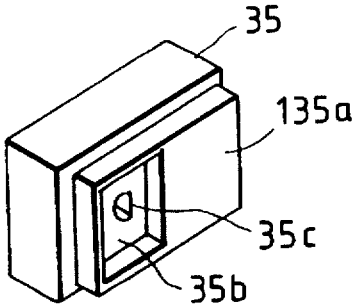
FIGS. 21 through 23 are perspective views showing three other embodiments of the closed cap portion of the cap.

FIG. 21 shows another embodiment of the cap 35. In the present embodiment, a hermetically sealing cap portion 135*a* is a planar member so that the discharge opening forming surface may not be contacted by air, and the hermetically sealing effect is further enhanced. Also, ink flows out of the discharge opening due to the surface tension of the ink and around the cap, the ink is contacted by the outside air and therefore, an increase in the viscosity of the ink or the adherence of the ink occurs in this portion, that is, occurs at a portion other than the discharge opening and thus, it becomes difficult for any problem to arise in the recording operation after the cap is opened.

Figure 22:
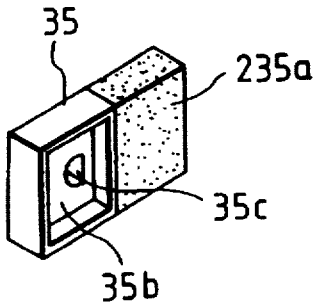

FIG. 22 shows still another embodiment of the cap 35. In the present embodiment, a hermetically sealing cap 235*a* is formed of a single-foamed porous block such as urethane foam, and the intimacy of contact with the unevenness of the discharge opening forming surface is improved and the pressing force of the cap can be reduced.

Figure 23:
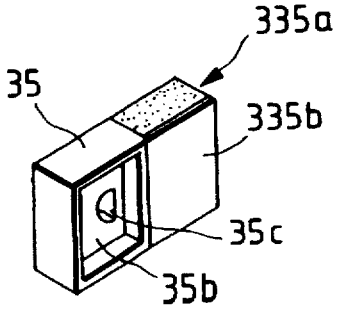

FIG. 23 shows yet still another embodiment of the cap 35. In the present embodiment, a skin layer 335*b* lying on the body of a hermetically sealing cap portion 335*a* in the form of continuously foamed urethane foam is formed on the surface which is in intimate contact with the nozzle, and the cap performance is ensured for a long period of time by the stability of the restitution coefficient which is the characteristic of continuously foamed urethane foam.

Figure 24A:
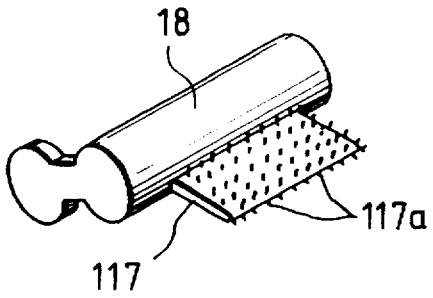
FIGS. 24A, 24B, 24C and FIG. 25 are perspective views for illustration of two other embodiments of the blade.
Figure 24B:
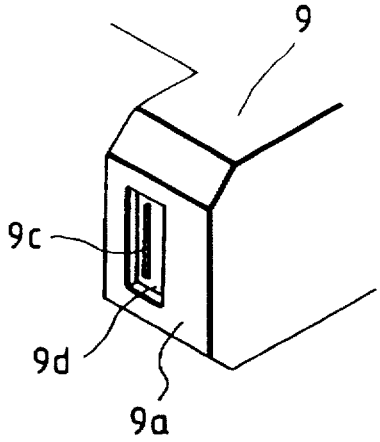
Figure 24C:
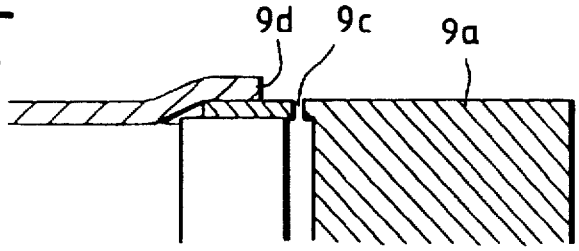

FIG. 24A shows another embodiment of the blade. The present embodiment, as shown in FIG. 24B or 24C, has a level difference on a surface 9*d* in which the discharge openings 9*c* are formed, and is also effective for wiping the surface at the inner side thereof. That is, in the present embodiment, short fibers 117*a* of a high molecular material are electrostatically attracted and thereby planted onto the whole surface of the blade 117 or a portion thereof which contacts with the nozzle surface, and this embodiment not only can wipe by the planted hair touching the surface at the inner side, but also can effectively remove elongate dust such as thread-like dust.

Figure 25:
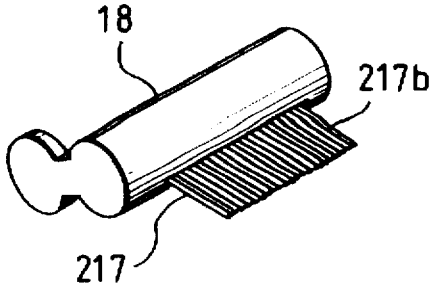

FIG. 25 shows still another embodiment of the blade. In the present embodiment, a blade 217 is in the form of a brush which can be formed by bundling fibers 217*b* of a high molecular material such as plastic. The present embodiment has a great wiping effect even in a case as shown in FIG. 24B or 24C wherein the groove in the discharge opening forming surface having a level difference as shown in FIG. 24B or 24C is deep, and since each fiber contacts with the surface to be wiped, the pressure contact force as a blade for the discharge opening forming surface may be small, and it will never happen that the durability of a surface treating layer of a water repelling agent or the like which may sometimes be applied to the discharge opening forming surface is spoiled.

Figure 26:
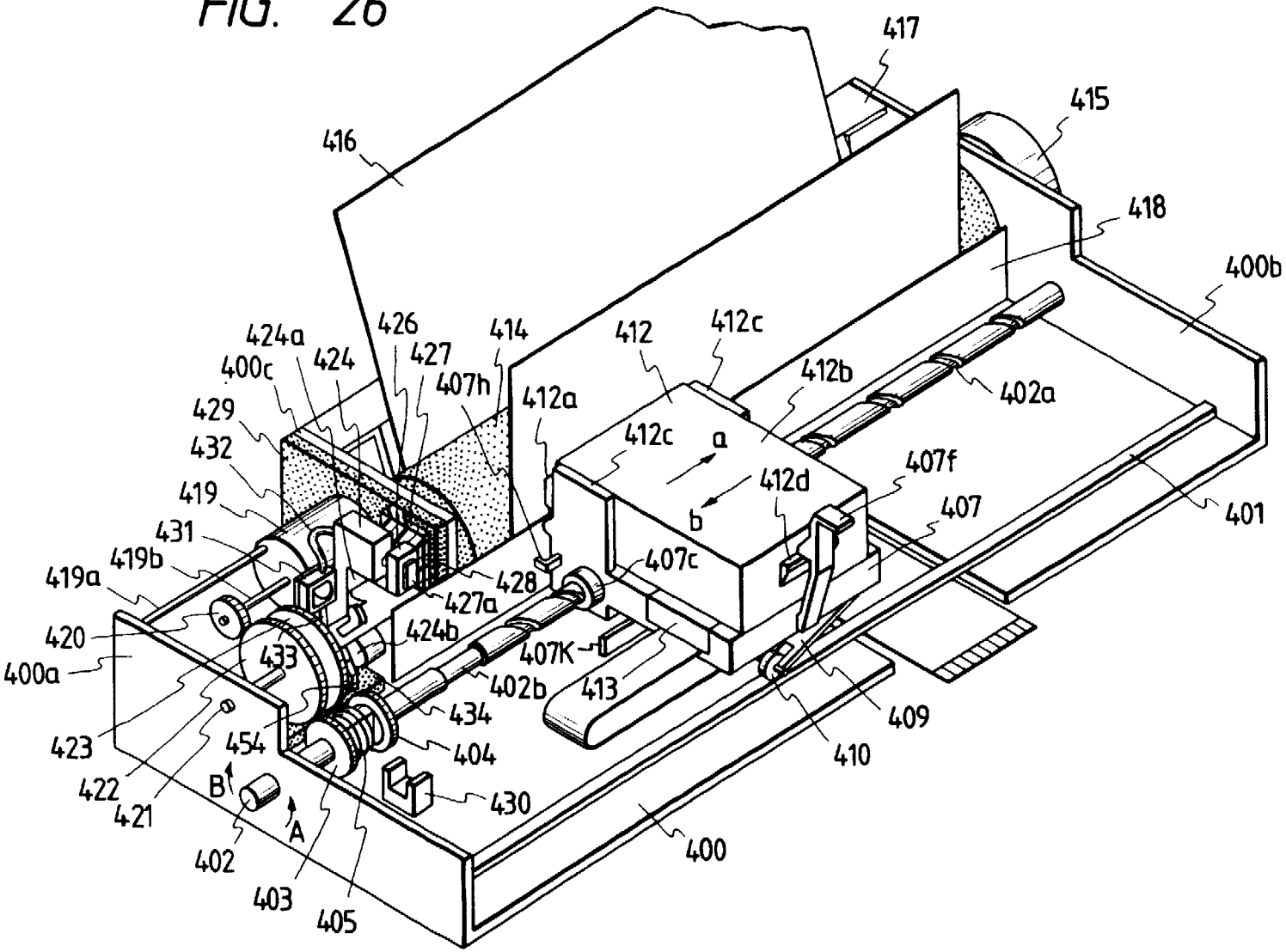
FIG. 26 is a schematic perspective view of still another embodiment of the ink jet recording apparatus.
Figure 27:
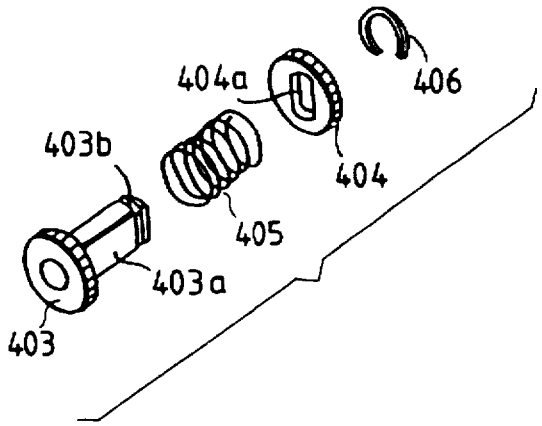
FIG. 27 is a schematic exploded perspective view showing the surrounding constitution of the transmission gear 3 in FIG. 26.

FIG. 26 shows another mode of accomplishing miniaturization according to the present invention, and in the following, description is made by referring to FIG. 26 to FIG. 38.

The specific features here are as summarized below. That is, for accomplishing miniaturization of recording apparatus, the apparatus has means capable of actuating a plurality of recovery mechanisms by utilizing one driving source to the maximum, comprising specifically a lead screw for moving the carriage in a reciprocal fashion, a cap member arranged capable of capping the surface having the discharge port of the above head arranged thereon, driving means for attaching and detaching the cap member relative to the head, a suction means for creating a negative pressure within the cap member, and means for capping by the cap member the head by transmitting the rotation of the lead screw in the process of the carriage penetrating from the recording region into the non-recording region and also actuating the above suction means.

By constituting the structure as described above, when the carriage moves to a predetermined position of the non-recording region from the recording region, the engaging pin of the carriage is fitted into the groove portion provided on the lead screw to stop the movement and also permits the clutch gear to mesh with the gear for driving head. Through the rotation of this gear, the cap member progresses toward the head to cap the discharge port surface and also the sucking means is driven to suck the ink from within the cap. Thus, the driving source for exclusive use could be obviated and the recovery actuation could be done by use of the driving source for carriage.

FIG. 26 is a schematic perspective view showing an embodiment of the ink jet recording apparatus according to the present invention.

In FIG. 26, 400 is a base for mounting the respective members discussed below, on which is provided standing side plates 400*a*, 400*b* and an intermedite side plate 400*c*. 402 is a lead screw which is axially supported freely rotatably between the side plates 400*a* and 400*b*, on which are formed a delivery screw portion 402*a* and a groove 402*b*. 403 is a transmission gear secured on one end of the lead screw 402, and 404 is a clutch gear which is engaged freely slidably in the axis direction relative to the transmission gear 403 and fitted outside of the lead screw 402 near the transmission gear 403 so that the driving force may be transmitted in the rotational direction.

405 is a coil spring which is mounted between the transmission gear 403 and the clutch gear 404 for constantly urging the clutch gear 404 toward the recording region direction. For regulating the position of the clutch gear 404 urged by the coil spring, O-ring 406 is engaged with the groove 403*b* formed at the end of the transmission gear 403. 407 is a carriage, and its details are as shown in FIG. 28. 407*a*, 407*b* are bearing portions fitted into the lead screw 402, 407*c* a pressing portion provided at the bearing portion 407*a*, 407*d* a shielding plate provided beneath the carriage 407, 407*e* guide portions of protruded shape provided on both sides of the front portion, 407*f* a headlock lever formed integrally with the carriage 407 by use of a plastic material having elasticity such as polyacetal, etc., 407*g* a hood portion formed at the front portion of the headlock lever 407*f*, 407*h* carriage lock portions mounted on both sides of the carriage 407, and 408 a driving pin at a predetermined position of the carriage 407 and obliquely along the lead angle of the lead screw 402.

Figure 28:
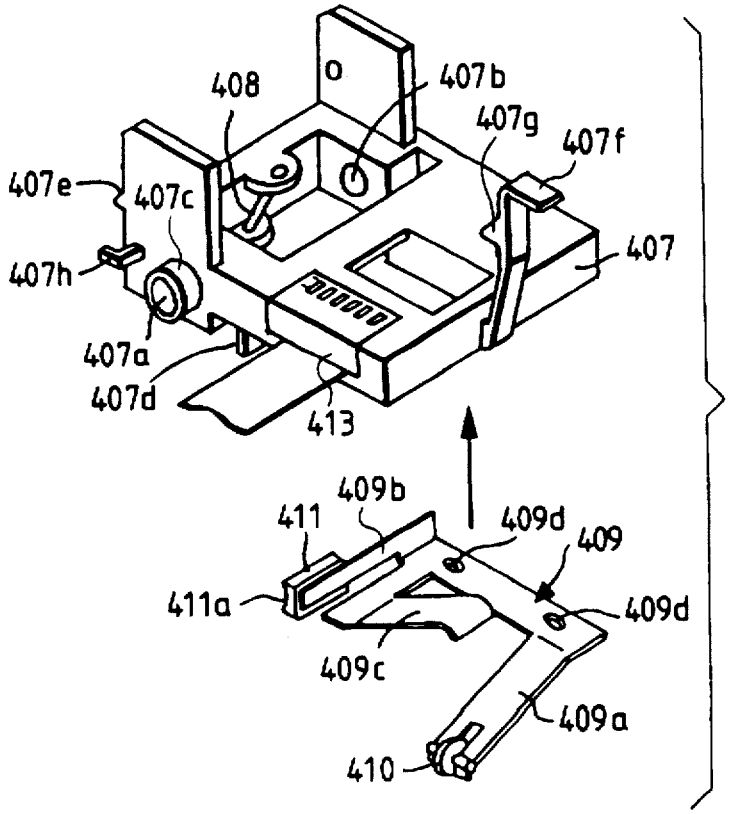
FIG. 28 is a schematic exploded perspective view showing the details of the carriage 407.
Figure 29:
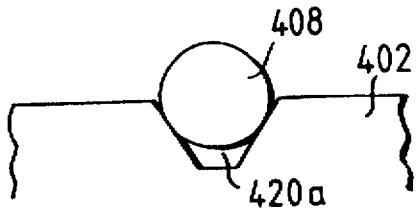
FIG. 29 is a schematic side view showing the engagement of the driving pin 408 and the screw portion 402*a;*

409 is a U-shaped carriage spring provided beneath the carriage 407 as shown in FIG. 28. 409*a* is a pressure contact portion formed at one end of the carriage spring 409, which is provided at the tip end freely rotatably with a guide roller 401, and pushes the rail portion 401 of the base 401 via the guide roller 410. 409*b* is a pad pushing portion having a pad 411 to be pushed against the lead screw 402 mounted at the tip end, and 409*c* is a leaping portion for facilitating removal of the head.

Figure 30:
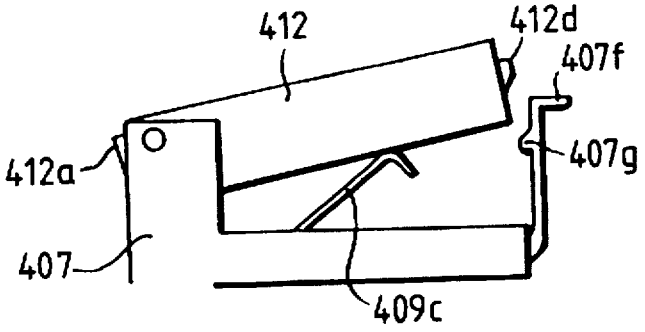
FIG. 30 is a schematic side view showing the state of the head 412 mounted onto the carriage 407.
Figure 31:
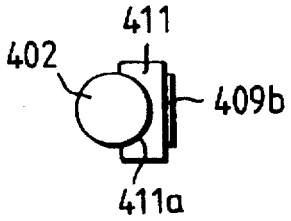
FIG. 31 is a side view showing the surrounding mechanism of the pad 411.

412 is a disposable type ink jet head comprising a head portion 412*a* and an ink tank 412*b* integrated, and is mounted on the carriage as shown in FIG. 30. 412*c* is a mounting pin inserted into the mounting portion of the carriage 407, 412*d* an engaging portion formed at the rear end of the head 412 at which the hood portion 407*g* is engaged during mounting of the head 412. 413 is a flexible contact provided on the upper surface of the carriage 409 and contactable with the electrode of the head 412, and 414 is a paper delivery roller which is arranged in parallel to the head screw 402 and conveys while winding paper for recording therearound. 415 is a paper delivery motor which drives the paper delivery roller 414 by rotation. 416 a paper pan which becomes the guide for the paper for printing 416 for delivering to the paper delivery roller 414.

418 is a paper pushing plate for preventing flexing of the printing paper 416 toward the ink jet head 412 side at the printing position. 419 a motor which is the driving source for the carriage 407. 409 a stay for fixing the motor 419 onto the side plate 400*a*, 419*b* a rotational shaft of the motor 419. 420 a pinion mounted at the shaft end of the rotational shaft 419*b*, 422 an idle gear which meshes with the pinion 420 and the transmission gear 403 to transmit the rotation of the pinion to the transmission gear 403, and its gear shaft 421 is axially supported on the side plate 400*a*.

Figure 32:
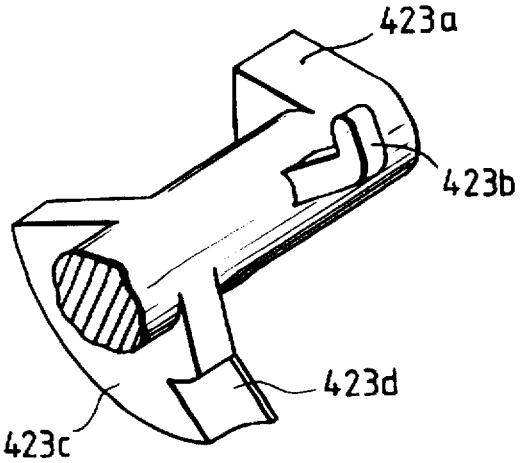
FIG. 32 is a schematic perspective view showing the details of the respective members formed integrally with the cap gear 423.

423 is a cap gear for rotating the cap member 427 as supported coaxially on the idle gear 422. The cap gear 423, as shown in FIG. 32, is provided with a lever 423*b* for pressing the suction means (pump) for recovery mechanism, a lock plate 423*c* forming a fan shape which is fitted into the carrier lock portion 407*h* of the carriage 407 to lock the carriage 407, and a tapered cam surface 423*d* formed at one surface of the lock plate 423*c*, respectively, by way of integral working.

424 is a cap lever mounted on the side plate 400*a*, and is provided with a contacting portion 424*a* in contact with the cam 423*a* and a spring portion 424*b* which imparts rotational force to the cap lever 424. 426 is a cap holder mounted on the front surface of the cap lever 424, and 427 is a cap member mounted on the front surface of the cap holder 426, having a rib 427*a* for improvement of adhesivity. 428 is a blade mounted on the cap lever 424. 429 a porous ink absorber applied with hydrophilicity treatment and mounted on the side plate 400*c*, and 430 is an interrupter for detection of the home position provided at the base bottom near the transmission gear 403.

Figure 33:
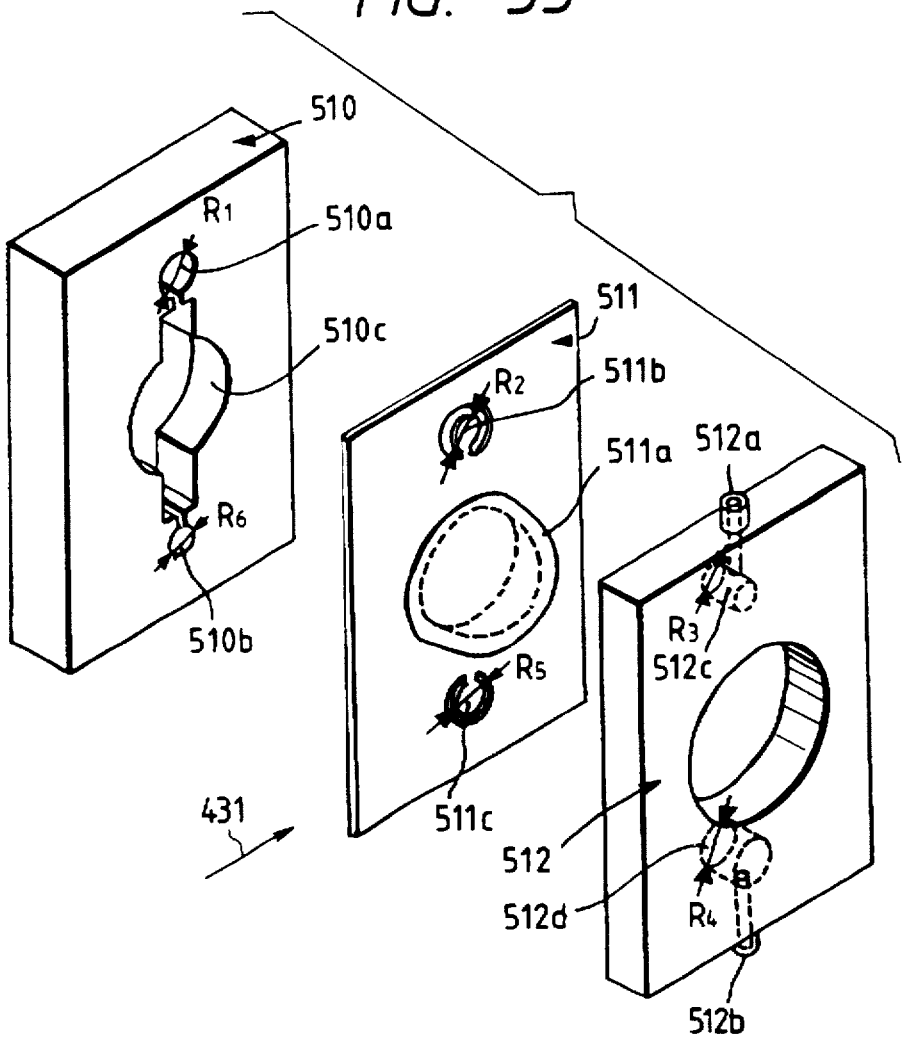
FIG. 33 is an exploded perspective view showing the details of the suction means 431.

431 is a suction means (pump) communicated to the ink absorber 429 and the cap holder 426, having the constitution shown in FIG. 33. In FIG. 33, 510 is a rigid base of the suction means 431, having a suction channel 510*a* with a diameter of $R_1$, a discharging channel 510*b* with a diameter of $R_6$, a main channel 510*c*, with the boundary portions of the respective channels being made in shape of slit. 511 is a member made of rubber equipped with a valve to be superposed on the base 510, with an elastically deformable hollow spherical absorbing portion 511*a* being formed at the central portion, and further a suction valve 511*b* is provided at the upper part, and a discharge valve 511*c* at the lower part. The suction valve 511*b* and the discharge valve 511*c* are generally within the plane of the member made of rubber 511, and formed freely flexably by punching out the sheet portion into horse's hoof shape. 512 is a pushing plate, which is fixed through the member made of rubber 511 on the base 510, and also has a suction port 512*a* closed and opened with the suction valve 511*b* and equipped with a valve portion 512*c* with a diameter $R_3$ smaller than the diameter $R_2$ of the valve 511*b* and a discharge port 512*b* equipped with a channel 512*d* with a diameter of $R_4$ larger than the diameter $R_5$ of the exhaust valve. The diameter $R_5$ of the exhaust valve is larger than the diameter $R_6$ of the exhaust path 510*b*, and the diameter $R_2$ of the suction valve is larger than the diameter $R_1$ of the suction channel. 432 is a suction tube communicated to the cap lever 424 and the suction means 431. 433 an exhaust tube of which one end is connected to the exhaust port 512*b* of the suction means (pump) 431, and 434 a waste ink absorber communicated to the exhaust tube 433 and also arranged beneath the pump 431.

Next, actuation of the embodiment according to the above-mentioned constitution is to be described by referring to FIG. 34 to FIG. 36.

First, when the reverse rotatable motor 419 rotates, the driving force is transmitted through the pinion 420, the idle gear 422 to the transmission gear 3, whereby the lead screw 402 rotates. When the lead screw 402 rotates in the direction A, the carriage 407 moves in the direction a, and conversely when the lead screw 402 rotates in the direction B, the carriage 407 moves in the direction b. The lead screw rotates alternately to the directions a, b corresponding to the recording information, thereby moving the carriage 407 in a reciprocal fashion, during which process ink is discharged through the discharge port of the head corresponding to the recording information or preliminary discharge signals.

Next, recovery actuation during printing data waiting, power source off will be described.

First, the carriage 407 is moved in the direction b to be brought into contact with the clutch gear 404. The pressing portion 407*c* of the carriage 407 pushes the clutch gear 404 against the urging force of the coil spring 405, thereby moving it from the state in FIG. 34A to as shown in FIG.

Figure 34A:
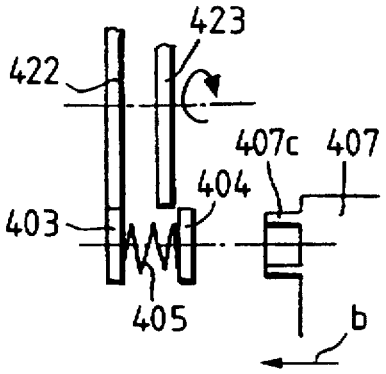
FIGS. 34A–34H are diagrams for illustration of the capping actuation of the embodiment shown in FIG. 26.
Figure 34B:
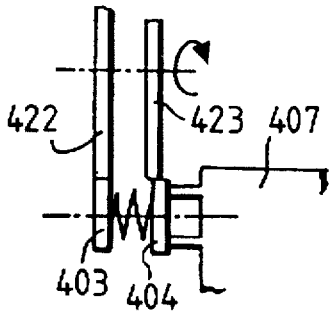

34B to have the clutch gear 404 meshed with the cap gear 423*c*. At this time, since the cam 423*a* remains under stationary state, as shown in FIG. 34E, the head portion 412*a* maintains the state apart from the cap 427. When the state of FIG. 34B is attained, the rotation of the idle gear 422 is transmitted through the transmission gear 403 and the clutch gear 404 to the cap member gear 423, whereby the cam 423*a* coaxial with the gear rotates to rock the cap lever 424 as shown in FIG. 34F.

Figure 34C:
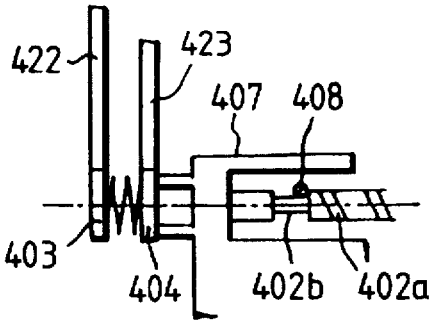
Figure 34D:
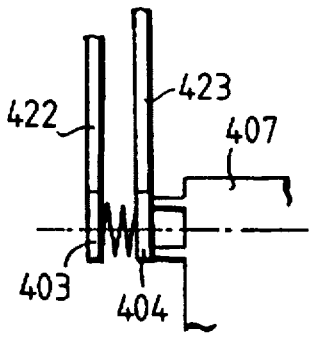
Figure 34E:
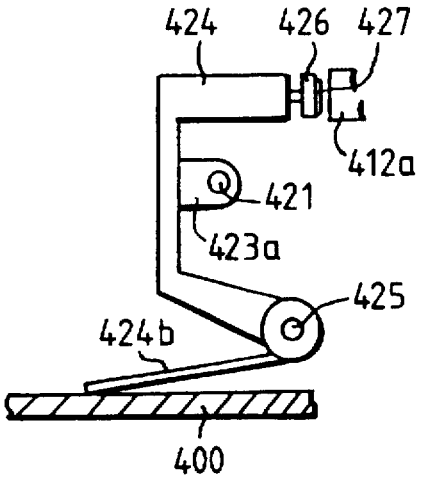
Figure 34F:
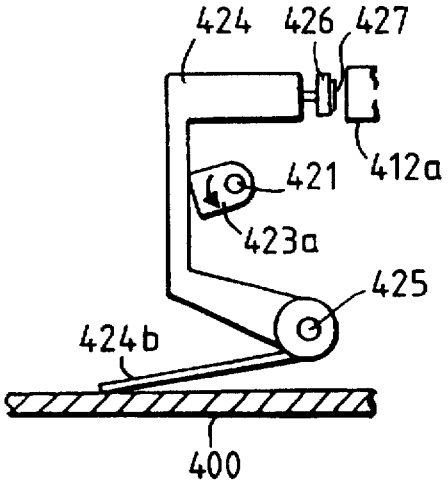
Figure 34G:
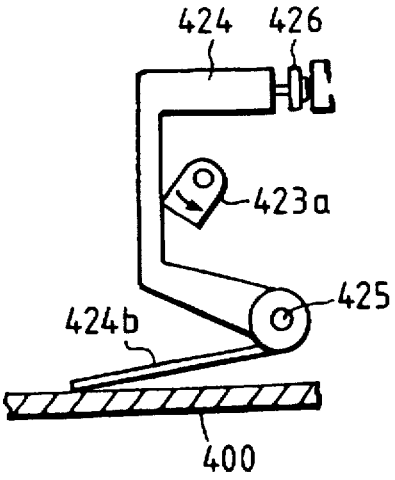
Figure 34H:
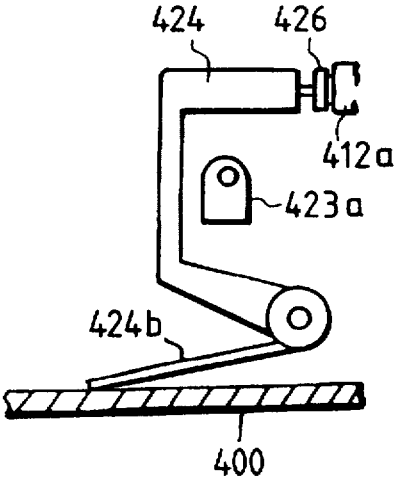

As shown in FIG. 34C, when the carriage 407 moves to the state where the clutch gear 404 completely meshes with the cam 423*a*, the driving 408 is dropped in the groove 402*b* of the lead screw 402 to stop the movement of the carriage 407. However, the cam continues to rotate, and after once pushing the cap lever 424 immediately after falling from the horizontal position, the cap lever 424 rotates clockwisely along the surface of the cam 423*a* in the process of progress of the rotation of the cam 423*a*. Along with the rotation of the cap lever 424, the cap member 427 approaches the head portion 412*a*, until both are eventually pressure contacted as shown in FIG. 34H. The positional relationship of the respective gears is under the state of FIG. 34D which is the same state as in FIG. 34C. The pressing force of the cap 427 can be set as desired by selecting the elastic force of the spring portion 424*b* of the cap lever 424.

Next, the suction recovery actuation is to be described by referring to FIGS. 35A to 35F and FIGS. 36A to 36C.

Figure 35A:
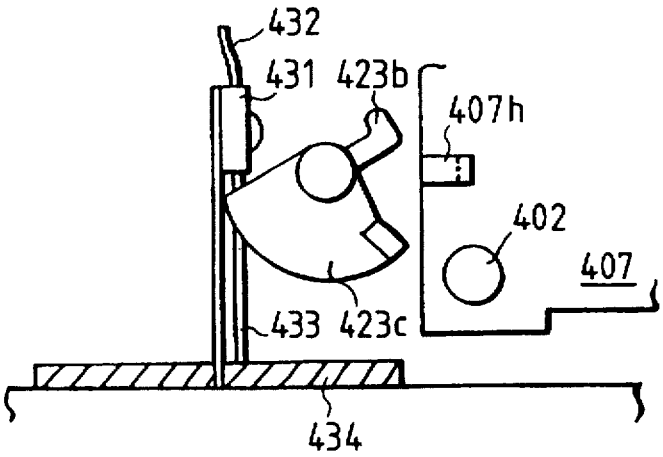
FIGS. 35A–35F are diagrams for illustration of the actuation of suction mechanism.
Figure 35B:
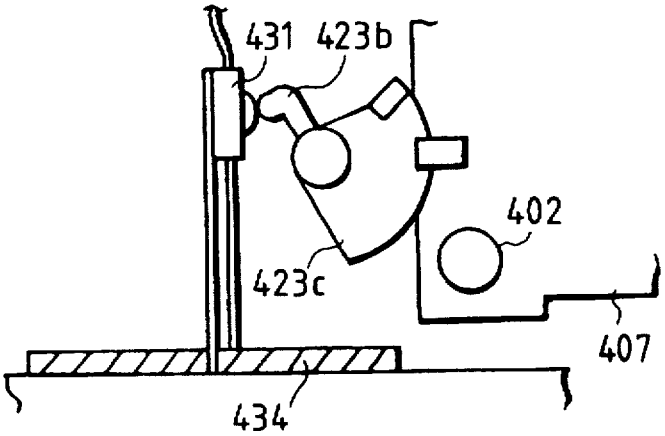
Figure 35C:
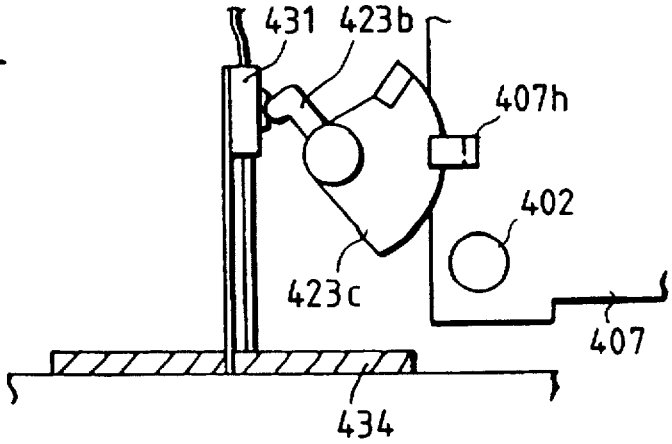
Figure 35D:
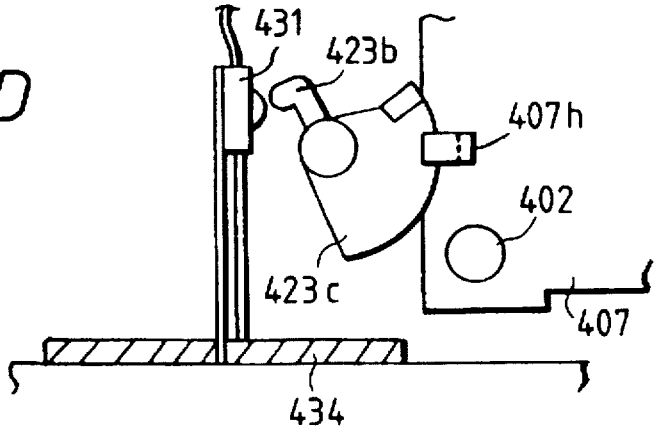
Figure 35E:
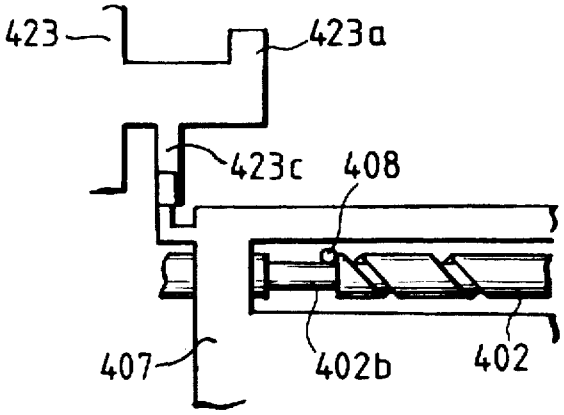
Figure 35F:
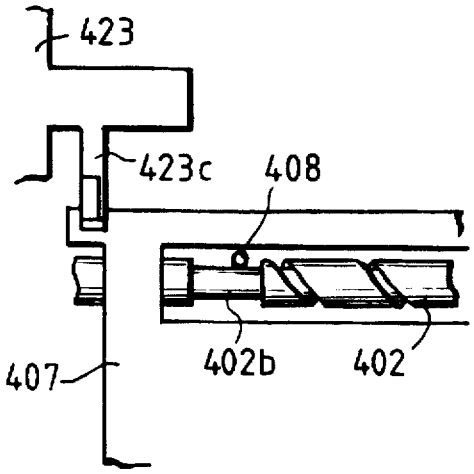
Figure 36A:
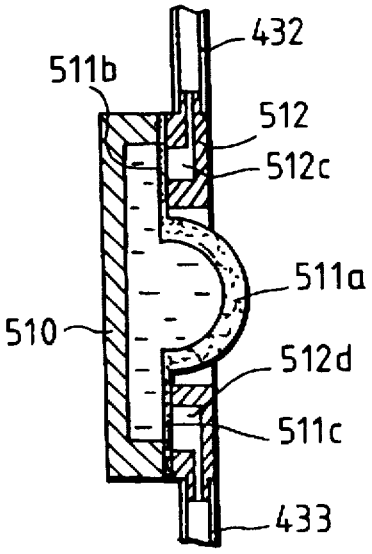
FIGS. 36A–36C are sectional views for illustration of the respective states within the suction means 431 accompanied with the suction actuation.
Figure 36B:
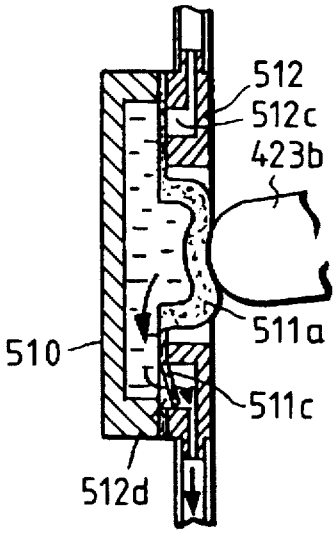

FIGS. 35A and 35E show the state where engagement of the carriage 407 with the lead screw 402 has come off. When the respective members shown in FIG. 32 rotate anticlockwisely from the state shown in FIG. 35A by the rotational force of the cap gear 423, the cam surface 423*d* of the lock plate 423*c* becomes engaged with the hook portion 407*h* of the carriage 407, and also the tip end of the pump lever 423*b* becomes lightly contacted with the surface of the suction means (pump) 431. Therefore, the suction portion (pump portion) 511*a* holds the inherent form as shown in FIG. 36A. At this time, the driving pin 408 is at a position apart from the end of the groove 402*b* of the lead screw 402, as shown in FIG. 35B.

When the cap gear 423 further rotates from the state in FIG. 35B, the suction lever 423*b* of the cap gear 423 presses the pump portion 511*a* of the pump 431 to deform the pump portion 511*a* as shown in FIG. 35B. At this time, the pump 431 has the suction valve 511*b* closed and only the discharge valve 511*c* opened, whereby the ink within the pump is pushed out downwardly.

Figure 36C:
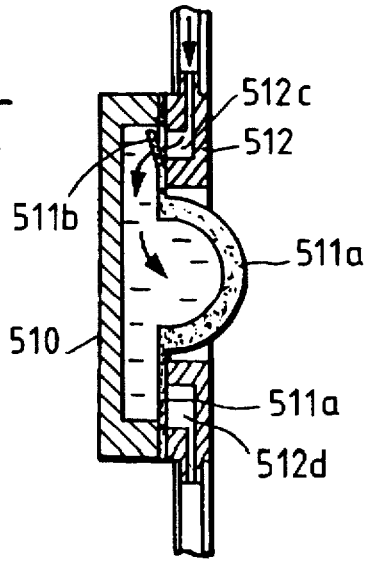

Subsequently, when the cap gear 419 is rotated reversely by reverse rotation of the motor 423, the suction lever 423*b* leaves the pump portion 511*a* of the pump 431, whereby deformation of the pump portion 511*a* is returned to the original. In this process, a negative pressure is created within the pump portion 511*a*, whereby the suction valve 511*b* opens and the ink is sucked within the pump portion 511*a* as shown in FIG. 36C. In this case, the cap member 427 is made under the stopped state to be closely contacted with the head 412 until a predetermined amount of ink is sucked.

When the cap gear 423 further rotates reversely, since the driving pin 408 and the screw portion 402*a* of the lead screw 402 are not engaged with each other, the cap gear 423 rotates with the carriage 407 being stopped. By rotating the cap lever 424 with the cam 423*a*, the cap member 427 is separated from the head portion 412*a*, and the cap member 427 becomes departed therefrom. Further, when the lead screw 402 rotates, since the carriage 407 is constantly urged toward the direction a with the coil spring 405, the driving pin 408 is pushed against the end surface of the groove 402*b* to be fitted into the 402*a*, and the carriage 407*a* moved in the direction a. As the carriage 407 moves, the clutch 404 also moves together therewith, whereby meshing with the gap gear 423 comes off and the rotation of the cap gear stops.

Figure 37:
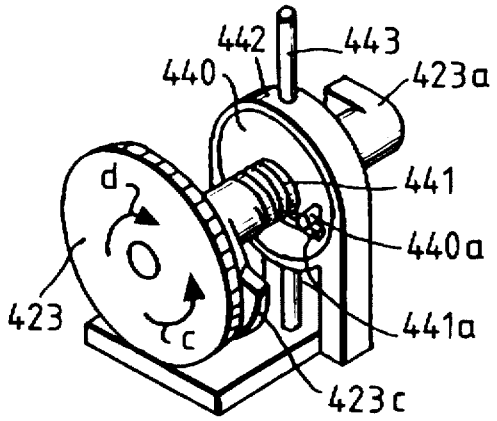
FIG. 37 is a schematic perspective view showing a suction means of another embodiment of the present invention.
Figure 38:
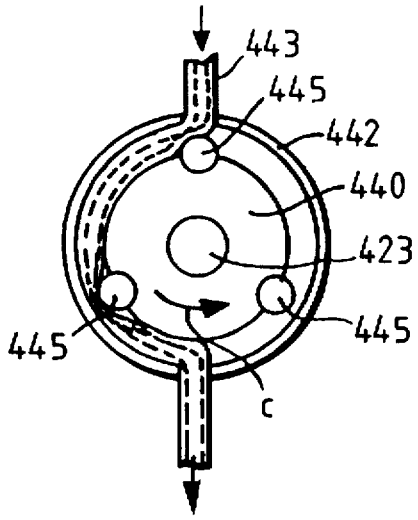
FIG. 38 is a sectional view showing details within the roller plate 440.

FIG. 37 is a schematic perspective view showing the principal part of the embodiment of the present invention using a tube pump for the above pump, and FIG. 38 a side view showing the details of the suction portion in FIG. 37. In this embodiment, since the same reference symbols are used for the same parts or those having the same mechanisms, the redundant description is omitted below.

440 is a roller plate mounted freely rotatably at the boss portion of the cap gear 423 and also provided with a pin 440*a* in the vicinity of the peripheral portion and in the axis direction, and 441 is a clutch spring which is wound around the boss portion of the cap gear 423, and transmits rotational force to the pin 440*a* when the cap gear 423 rotates with the hook portion 441*a* provided at the free end. The clutch spring 441 becomes loosened state of the clutch spring 441 when the cap gear 423 rotates in the direction d to give no urging force, whereby the roller plate 440 will not rotate. 442 is a housing fixed on the base, and 443 is a suction tube which is worked with an elastic material such as rubber, etc. and arranged along about half of the inner circumference of the housing 442. 445 are three rollers provided at equal angles (120°) on the roller plate 440, which rotate while rubbing against inside of the suction tube 443.

Next, the actuation of the embodiment of the tube pump according to the above constitution is to be described. In this embodiment, the description up to the capping actuation is the same as in the above embodiment and hence omitted.

Rotation of the cap gear 423 is transmitted to the roller plate 440 through the clutch spring 441 to rotate the roller plate 440 in the direction c. The roller 445 rotates simultaneously with rotation of the roller plate 440, and the suction tube 443 is rubbed with the roller 445, whereby a negative pressure is created within the suction tube 443 on the cap 427 side, and the ink is suctioned from the cap member 427. When the cap gear 423 is rotated for a predetermined time and then rotated reversely, the hook portion 441*a* will get apart from the pin 440*a*, whereby the roller plate 440 remains stationary and therefore the roller 445 does not press and move the suction tube 443. Accordingly, no suction actuation occurs and therefore there is no fear of counterflow of the ink. The recovery actuation of the carriage to the printing region, etc. is the same as in the above embodiment, and its description is omitted.

The present invention is not limited to the constitutions described in detail above, but any constitution which can accomplish the object of the present invention may be available.

As is apparent from FIG. 26 to FIG. 38, in the ink jet recording apparatus equipped with a carriage moving in the main scanning direction with an ink jet head mounted having a discharge port for discharging ink mounted thereon, the constitution is made to be equipped with a lead screw for moving the above carriage in a reciprocal fashion, a cap member arranged cappably on the surface where the discharge port of the above head is arranged, a driving means for attaching and detaching said cap member relative to said head, a suction means for creating a negative pressure within the above cap member and a means for capping the above cap member over the above head by transmission of the rotation of the above lead screw to the above driving means in the process of the above carriage penetrating from the recording region to the above non-recording region simultaneously with actuating the above suction means, and therefore no driving source for exclusive use for capping and suction action is required to be provided, thereby making the constitution simple and providing an ink jet recording apparatus which can be made lower in cost and miniatuarized.

Whereas, the lead screw as described above is a singlethread screw and relatively more expensive as compared with a multiple thread screw generally formed and used for mechanical element. For this reason, it has been determined to provide an ink jet printer by utilizing a multiple lead screw for obtaining a further inexpensive printer. As the multiple thread screw, an even number thread screw has more advantages, because its symmetrical shape can be easily obtained in the positions of thread, groove, and width. The number of threads should be preferably determined depending on the recording speed, the printing density, the number of discharge ports of that printer.

Accordingly, if a lead screw obtained by the rolling system capable of bulk production at low cost is used, because the shapes of groove and thread are required to become symmetrical, it is necessary to provide a multiple thread lead screw such as 4 or 6 threads. For this reason, after the driving pin 408 of the carriage was separated from the lead screw, when the lead screw was reversed, it was observed that the driving pin 408 of the carriage meshed with a lead different from the lead previously used. In such case, it has been found that recording precision may be lowered, or the carriage 412 may initiate scanning before opening of the cap 427*a* in some cases.

Figure 39A:
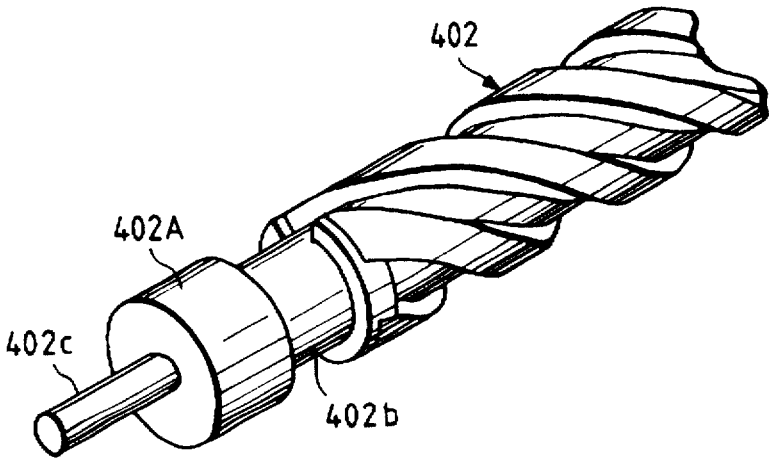
FIGS. 39A and 39B are respectively a schematic perspective view and an exploded perspective view showing the details of the lead screw according to the present invention.
Figure 39B:
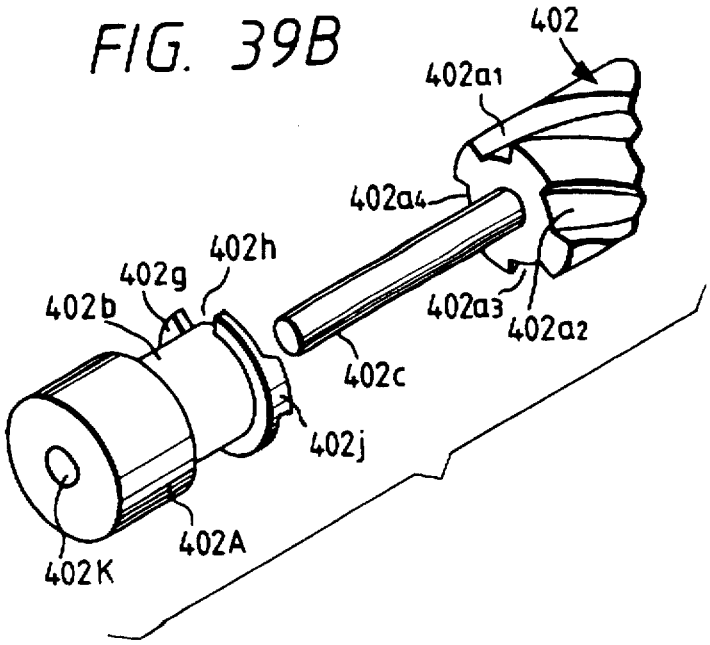
Figure 40:
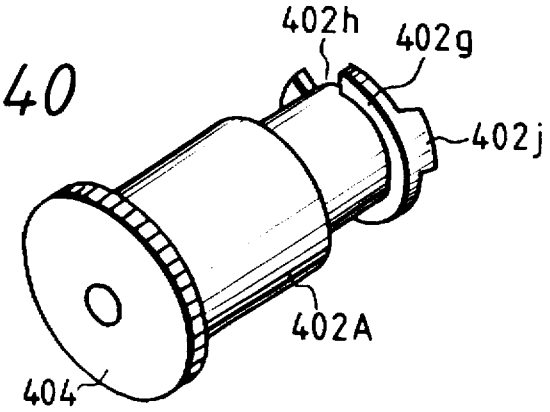
FIG. 40 and FIG. 41 are perspective views showing two other examples of the lead screw.
Figure 41:
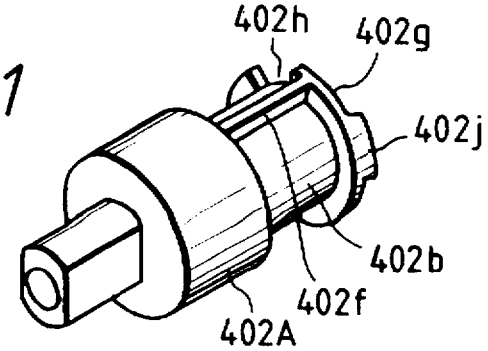

FIG. 39 to FIG. 41 make avail of the advantage of the above-mentioned multiple thread lead screw to solve its inherent task, showing an example of a constitution equipped with a regulating member joined to the end of said lead screw and also, except for one of said miltiple thread lead grooves into which driving members for the above-mentioned carriage are fitted, having members for impeding the egress and ingress of said driving members provided as faced to the ends of other grooves.

FIG. 39A is an assembled view of a four-thread lead screw 402 holding the clutch gear, the transmission gear 403 as described in the end region (not shown), and FIG. 39B its exploded view.

The lead screw 402, as shown in FIG. 39A, 39B, has four threads of spiral lead 402*a*1, 402*a*2, 402*a*3, 402*a*4 provided on the peripheral surface. At the center of the end is provided a shaft 402C, to which shaft 402C is fitted outside thereof a screw boss 402A formed by a material such as plastic, etc.

Inside of the screw boss 402A, a regulating side plate 402*g* having an opening 402*h* provided as opposed to the lead groove 402*a*1, and three nails 402*j*, 402*j*, 402*j* fitted correspondingly one by one to the respective lead grooves 402*a*2, 402*a*3, 402*a*4. In the drawing, there is shown a perspective view in which only one nail 402*j* can be expressed. A predetermined portion of the screw boss 402A near the lead screw 402 having these provided thereon is provided with a groove 402*b* for permitting the driving pin 408 of the carriage 407 to come thereinto when it comes off. 402K is a mounting hole, into which the shaft 402C is inserted.

The driving pin 408 can move between the groove 402*b* and the lead groove 402*a*1 only through the opening 402*h* relative to the lead grooves 402*a*1, 402*a*2, 402*a*3, 402*a*4, and impeded of its progress by the regulating plate 101*b* relative to other lead grooves 402*a*2, 402*a*3, 402*a*4. Thus, the carriage 7 could move similarly as in the case of the single thread lead groove as described above, and the advantages of low cost, precision stabilization of the multiple thread groove could be fully exhibited.

FIG. 40 and FIG. 41 are perspective views showing two other embodiments of the screw boss 402A.

In FIG. 40, the clutch gear 404 is provided integrally at the end of the screw boss 402A, as contrasted to FIG. 26, in which the clutch gear 404 is provided separately from the screw boss 402A. By doing so, no clutch gear 404 is required to be provided separately, whereby the cost could be reduced.

When the boss of the gear formed with the constitution shown in FIG. 40 is moved corresponding to the movement of the carriage, the three nails 402*j* must be surely fitted again to the respective predetermined lead grooves when it is restored. In this embodiment, since the constitution is such that the length of the nail 402*j* is ensured as corresponding only to the amount of movement of the boss 402A and at least a part of the nail 402*j* continues to be inserted into the corresponding lead groove, the corresponding relationship can be maintained, whereby the driving pin 408 can be surely restored to the lead groove 402*a*1 by passing through the opening 402*h*. Other than this constitution, the above object can be accomplished by making the shaft 402C polygonal corresponding to the movement of the clutch gear 404 thereby to regulate the movement state, or fixing the spring 405 surely on the gear 404. In such case, the above-mentioned fitting portion should be rather preferably made smaller.

In FIG. 41, the stopper portion 402*f* is provided on the groove 402*b* as extended in the shaft direction from the side portion of the opening 402*h* of the screw boss 402A. By doing so, in performing joining actuation of the carriage 407, the driving pin 408 can be prevented from coming again into the groove 402*b*.

The single thread utilization constitution of the multiple thread lead screw as described above has the advantage that the carriage can be moved at low cost and more accurately, because the precision of registration is particularly demanded when the above head detachable relative to the carriage is used.

The embodiment in FIG. 41, having the boss 402A different in form from the gear 404 and free from slide movement, may also have the above stopper portion 402*b* arranged by providing a stopper portion shaped in a groove which guides roughly the movement locus of the driving pin 408. In short, the lead screw constitution may be such that the single thread of a multiple thread screw is given to the driving pin 408 in the recording region, and a single thread groove with rough precision is corresponded to the non-recording region.

According to the above-mentioned boss constitution, the driving pin of the carriage can enter and exit from the groove of the regulating member only through one specific groove of the lead grooves provided in multiple threads, whereby entering into and exit from other grooves of the driving are excluded. Accordingly, even if lead grooves may be provided in multiple threads during working of the lead screw, there is no trouble in actuation of the carriage at all.

Also, when the driving pin of the carriage is positioned on the groove of the regulating member (screw boss) through a specific lead groove, the gear pressed by the carriage transmits rotational force to the capping mechanism side. Therefore, capping can be effected accurately as associated with the movement of the carriage.

Next, the mechanism which necessitates no clutch gear 404 mechanism shown in FIG. 26 to FIG. 41, and further can perform capping surely with reduced carriage movement amount is described by referring to FIGS. 42A–42C to FIG. 44.

The characteristic of this mechanism is to make the pitches of the lead grooves different such as making pitch of the lead groove of the lead screw engaged with the driving pin 408 of the carriage as described above rough in the recording region continuously to the non-recording region, while making it finer in the vicinity of the home position.

According to the above characteristic, at the home position portion where the pitch of the lead groove of the lead screw is fine, the movement distance of the carriage can be small, whereby superfluous movement of the carriage can be excluded, and also the capping actuation can be performed under low load. As the result, the constitution of the gear mechanism or the clutch mechanism can be made simpler.

The description is now given below by referring to FIGS. 42A–42C to FIG. 44, but the same description of the constitution as in FIG. 26 will be omitted.

402 is a lead screw axially supported freely rotatably between the side plates 400*a*, 400*b*, and has a lead groove 402*a* with a rough pitch and a lead groove 456 with a fine pitch near the side end of its home position.

403 is a transmission gear, comprising the transmission gear 403 and the clutch gear 404 shown in FIG. 26 integrated and having a gear width simultaneously engageable with the idle gear 422 and the cap gear 423.

The home position detection plate 407K mounted on the carriage bottom is provided so as to be fittable into the home position sensor 430 provided on the base 400. The home position sensor 430 is a transmission type photointerrupter sensor, and a stopper 454 is provided in the vicinity so that the carriage can be stopped when it is fitted to the optimum position within the home position sensor 430 of the detection plate 407K.

451 is a coil spring which is fitted outside of the lead screw provided with the transmission gear 403A at its other end and urges the lead screw 402 toward the transmission gear. For regulating the position of the coil screw 451, a thrust stop wheel 450 is fitted and fixed outside of the lead screw 402. 453 is a bearing for supporting the lead screw 402 freely rotatably on the side plates 400*a*, 400*b*, respectively, and 452 is a guide shaft for thru-guide of the movement of the carriage 407A.

Figure 42A:
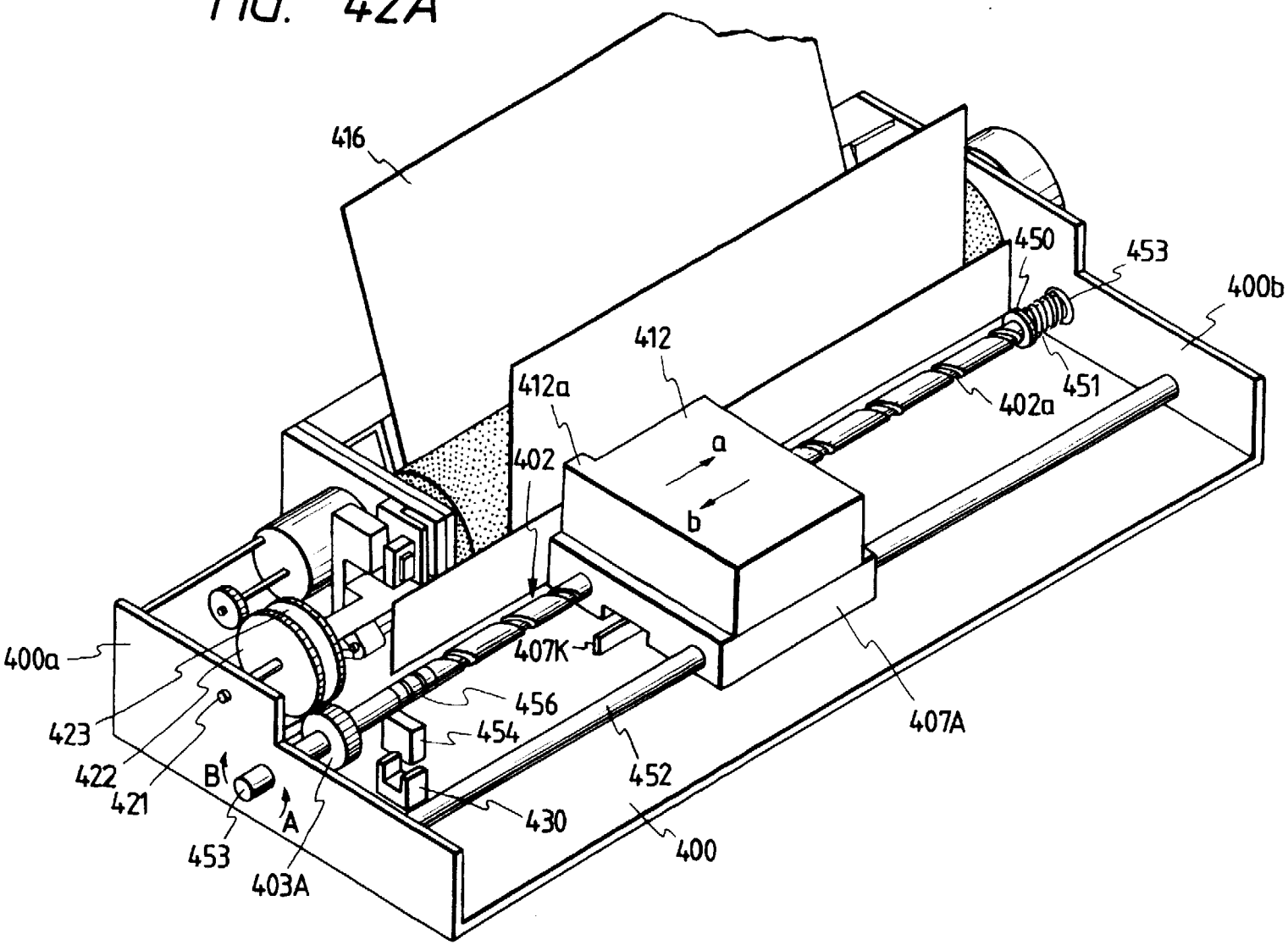
FIG. 42A is a schematic perspective view showing another embodiment of the ink jet recording apparatus according to the present invention.

In FIG. 42A, the recovery actuation during the printing data waiting, power source off is performed by moving the carriage 407A toward the arrowhead b, where the carriage 407A performs preliminary discharging at the position opposed to the end surface of the ink absorber 429. Also, after the head surface 412*a* is cleaned with the blade 428, the end surface of the carriage 407*a* contacts the stopper 454, whereby the carriage 407A is stopped. At this time, the driving pin of the carriage 407A is engaged with the lead groove 402*a* of the lead screw 402. When the lead screw 402 further rotates toward the arrowhead B, the lead screw 402 moves toward the arrowhead a while compressing the coil screw 450. Since the transmission gear 403A is fixed on the lead screw 402, it moves from the state in FIG. 42B to the state in FIG. 42C and the transmission gear 403A meshes with both the idle gear 422 and the gap gear 423. At this time, since the cam 423*a* remains stationary, the cap holder 426 is apart from the head surface 412*a*.

Figure 42B:
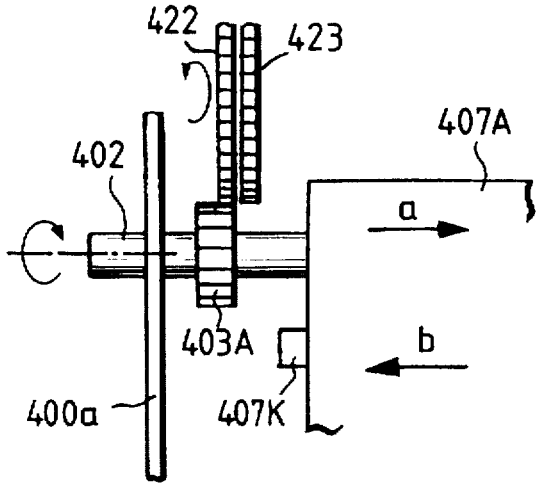
FIG. 42B and 42C are schematic sectional views of the gear portion for illustration of the actuation of the embodiment in FIG. 42A.
Figure 42C:
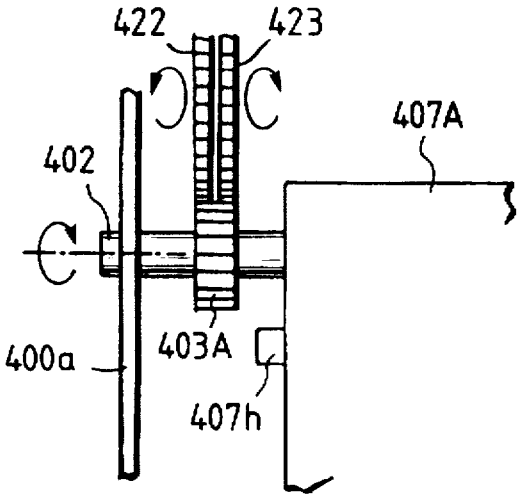

When the state in FIG. 42C is attained, the rotation of the idle gear 422 is transmitted through the transmission gear 403A to the cap gear 423, whereby the cam 423*a* coaxial with the cap gear 423 rotates to rock the cap lever as shown in FIG. 34F. When the driving pin 408 of the carriage 407A comes into the lead groove 456 of the lead screw 402, the movement of the carriage 407A stops. However, the cam 423*a* continues to rotate, and after pressing once the cap lever 424 immediately after dropping from the horizontal position, the cap lever 424 will rotate clockwisely along the surface of the cam 423*a* in the process where rotation of the cam 423*a* proceeds. Simultaneously with rotation of the cap lever 424, the cap 27 approaches the head portion 412*a* as shown in FIG. 34G, until the both are ultimately pressure contacted as shown in FIG. 34H.

Next, when printing is to be performed by opening the cap 427, the actuation reverse to the capping actuation as described above may be performed. First, when the lead screw 402 is rotated toward the arrowhead A by rotating the motor 419, the driving pin 408 is engaged with the lead groove 456 of the lead screw 402, and not with the lead groove 402*a*, whereby the carriage moves slightly and also the cap gear 423 rotates. Since the driving pin 408 exists in the lead groove with fine pitch, the torque applied on the driving pin 408 is small, and no excessive load will be applied to the carriage 407A.

As associated with the rotation of the cap gear 423, the cam 423 rotates to rotate the cap lever 424, whereby the cap 427 and the head surface 412*a* of the head 412 separate from each other to have the cap 427 opened. When the lead screw 402 further rotates from this state, the driving pin 408 of the carriage 407*a* will progress from the lead groove 452 to the lead groove 402*a*, whereby the carriage 407*a* is migrated to the recording region.

On the other hand, as the driving pin 408 progresses into the lead groove 402*a*, the force of the lead screw 402 for compressing the coil spring 451 is weakened, and the lead screw 402 moves in the left direction in FIG. 42A, with the lead screw 403A being returned to the state in FIG. 42B. As the result, the rotation of the gear gap 423 stops and the capping mechanism completes its actuation.

Figure 43:
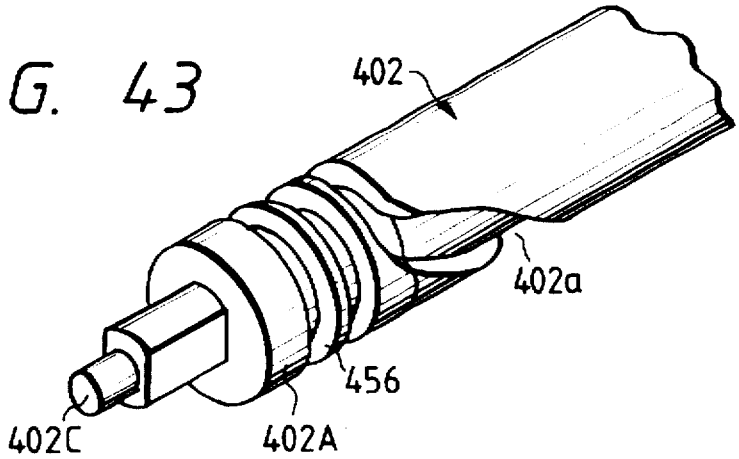
FIGS. 43 through 45 are perspective views of the principal parts showing respectively three other embodiments of the lead screw 2.
Figure 44:
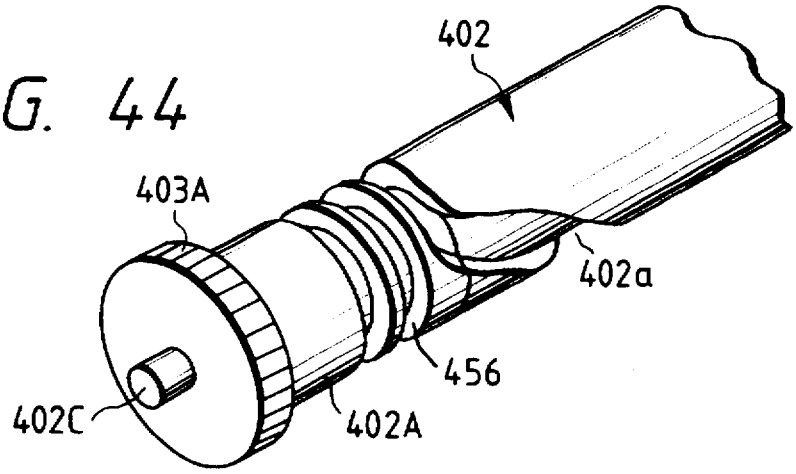
Figure 45:
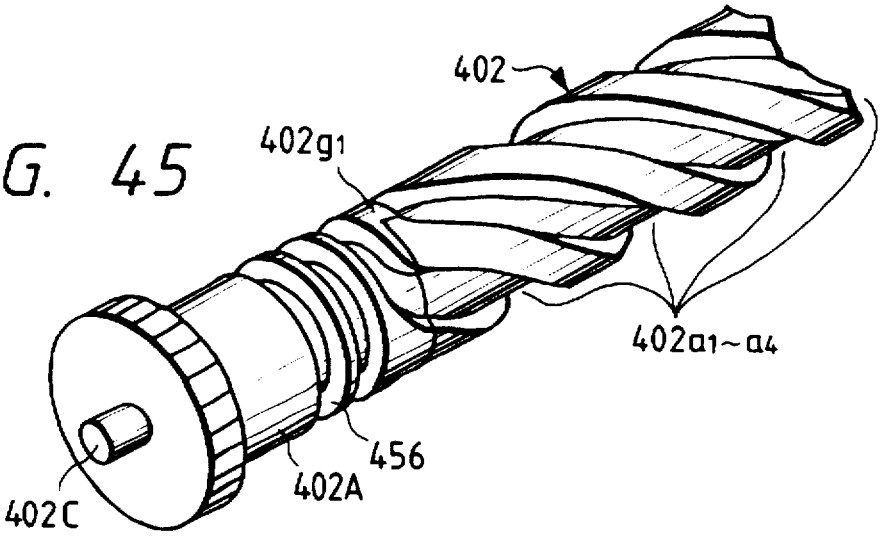

FIG. 43 to FIG. 45 are perspective views showing three other embodiments of the lead screw 2.

In FIG. 43, the whole of the lead screw is formed by use of a metallic material, and only the lead groove 402*a* is formed around the whole circumference thereof. At the ends of the lead screw are provided the shaft 402*c* and the boss. Into the boss is pressurized and secured the boss portion 402A worked by use of a plastic material. The boss portion 402A has a lead groove 456 communicated to the lead groove 402*a* formed by molding. Into the boss of the lead screw 402 thus completed is fitted the transmission gear 403A not shown.

In FIG. 44, as contrasted to the lead screw 402 with the constitution shown in FIG. 43, the transmission gear 403A is integrated with the boss portion 402A. By doing so, the number of parts can be reduced.

In FIG. 45, bulk production and reduction in cost are effected by facilitating preparation of the lead screw 402 as described in FIG. 41, and the lead groove 402*a* is not a single thread, but lead grooves 402*a*1–*a*4 of multiple threads are formed according to the rolling system. In this case, unless the engagement with the driving pin is a single thread, the driving pin will come into other lead grooves 201A during reversal in direction of rotation, whereby registration slippage occurs. Accordingly, for prevention of this, a regulating member 402*g*1 which locks other lead grooves except for a single thread is interposed between the lead grooves 402*a*2–*a*4 and the lead groove 456.

In the ink jet recording apparatus as described above, since the pitches of the lead groove of the lead screw for carriage driving are made different with the pitch in the recording region being made rough, while the pitch is fine at the home position, superfluous movement of the carriage is obviated to enable capping under a low load state. Also, by use of a lead screw, the positional precision between the recording head and capping can be made higher, whereby sure capping can be effected.

In addition, since the lead groove portion at the home position is assembled by forming it on a separate part from the main body of the lead screw, the lead screw can be easily manufactured. The lead screw rockable at the home position rocks the transmission gear mounted at its end to transmit the rotational force to the capping mechanism side, thereby effecting capping the cap over the head surface. Therefore, the gear change-over can be done with the minimum number of gears.

Next, description is made of the capping mechanism (modification of the constitution in FIG. 3) which can contribute to the small scale and high precision recovery mechanism of the present invention and which can be utilized for FIGS. 34E–34H, by referring to FIG. 46 to FIG. 49.

Rotation occurs with the shaft 425 as the center by the cam 423*a* which rocks by receiving the gear driving force as described above. The cap unit 4241 including the cap lever 424 has integrally the spring portion 424*b*, the mounting portion 4251 fitted to the shaft 425, as described above. For maintaining the closed state between the cap and the head surface during capping in the prior art, the cap is required to be strongly pressed against the head surface. For this reason, a high torque type must be used for the motor for driving, whereby the consumption power was greater. Also, since the a rubber cup is compressed, the volume of the cap closed space was reduced to become under pressurized state and bring about retreat of the meniscus within the nozzle, whereby defective discharging was generated. An object of this embodiment is to provide a small scale and inexpensive ink jet recording apparatus which can improve adhesivity between the head surface and the cap, and also accomplishes small power consumption.

This embodiment has mounting members of the cap mounted on the movable member for moving the cap so as to be rockable upper and down, right and left, thereby enabling formation of the closed state stably and completely even when the discharge surface of the head may be slanted.

Also, for improving the mountability between the discharge surface and the cap, it is desirable to provide a rib by use of an elastic material on the capping surface of the cap so as to be adherable to the recording surface of the above-mentioned head.

The rib provided on the capping surface of the cap makes a no air leak portion between the cap and the head, making adhesivity further complete. Therefore, even if mounting of the head may come out of the specified value or may be slanted by change with lapse of time, capping can be done while maintaining constantly good adhesivity.

Since registration between the recording head and the cap is done by use of the lead screw as described above, the constitution improved in positional precision during capping is considered as a premise.

Figure 46:
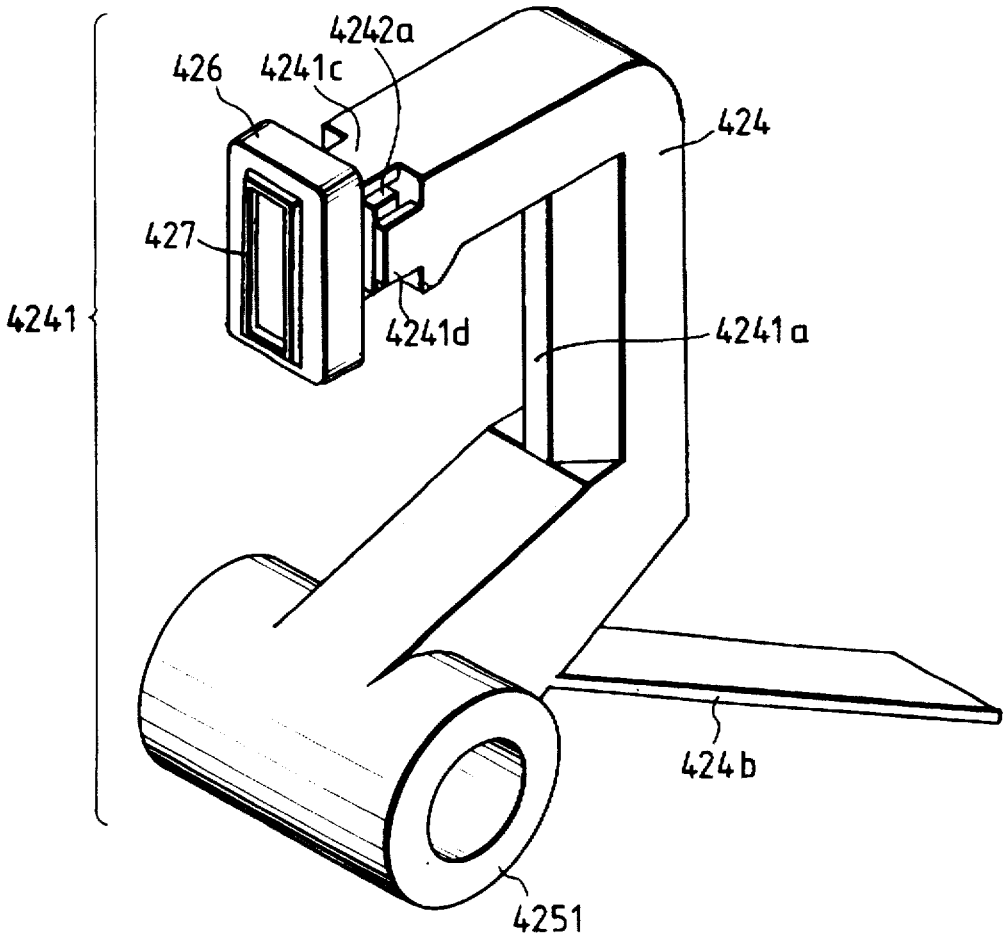
FIG. 46 is a perspective view showing the details of an embodiment of a cap unit comprising a cap lever 4241 and a cap 4243.
Figure 47:
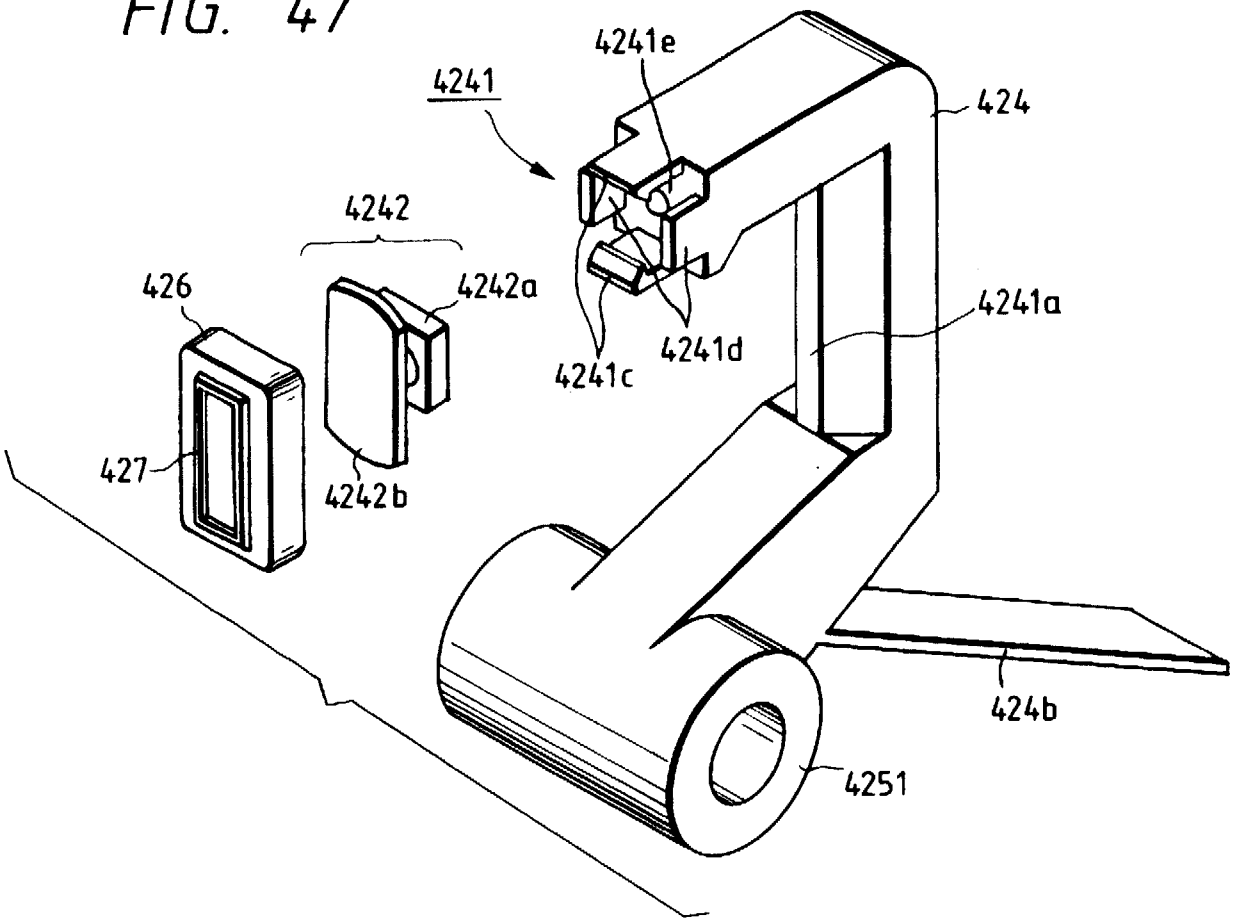
FIG. 47 is an exploded perspective view showing the details of the cap 4243 in FIG. 46.

FIG. 46 is a perspective view showing the details of the cap unit comprising the cap lever 424 and the cap 426, and FIG. 47 an exploded perspective view showing details of the cap 426.

424 is a cap lever as the movable member, which is mounted freely rotatably on the lever shaft 425 mounted on the intermediate side plate 400*c* of the base 40, and has the contact portion 4241*a* in contact with the cam 423*a* and the spring 424*b* for giving rotational force to the cap lever 424 integrally formed thereon. Further, the cap lever 424 has the hook portion 4241*c* for mounting on the cap holder 4242, the guide portion 4241*d*, and the semispherical type R-shaped projection 4241*e* integrally formed thereon. In this embodiment, the cap lever 424 is worked by use of a plastic material having elasticity such as polyacetal, etc., but this is not limitative, but any material may be available, provided that it exhibits similar characteristics.

4242 shown in FIG. 47 is a cap holder made of a metal, having the mounting portion 4242*a* for mounting on the cap lever 424 formed integrally thereon. The mounting portion 4242*a* is fitted freely within the space formed by the hook portion 4241*c* and the guide portion 4241*d* so that the cap holder 4242 as a whole can be oscillated in all the directions such as up and down, right and left, obliquely, etc. With such a constitution, adhesivity between the head and the cap can be improved.

On the back surface of the cap 426 is formed integrally the hook portion 4243*a* to be fitted into the cap holder 4242. Also, on the front surface of the cap 426 is formed a rib 427 as the cap member 427 (its height is set to the extent that the cap member does not contact the discharge port of the head 412) for improving adhesivity with the head 12. The rib 427 comprises a member enhanced in flexibility, for example, a rubber material, etc. And, by making its height to the extent that the cap member does not contact the discharge port of the head 1412, the surface area within the cap can be made smaller to prevent solidification by drying of the ink on account of gas permeability of the rib 427.

Figure 49:
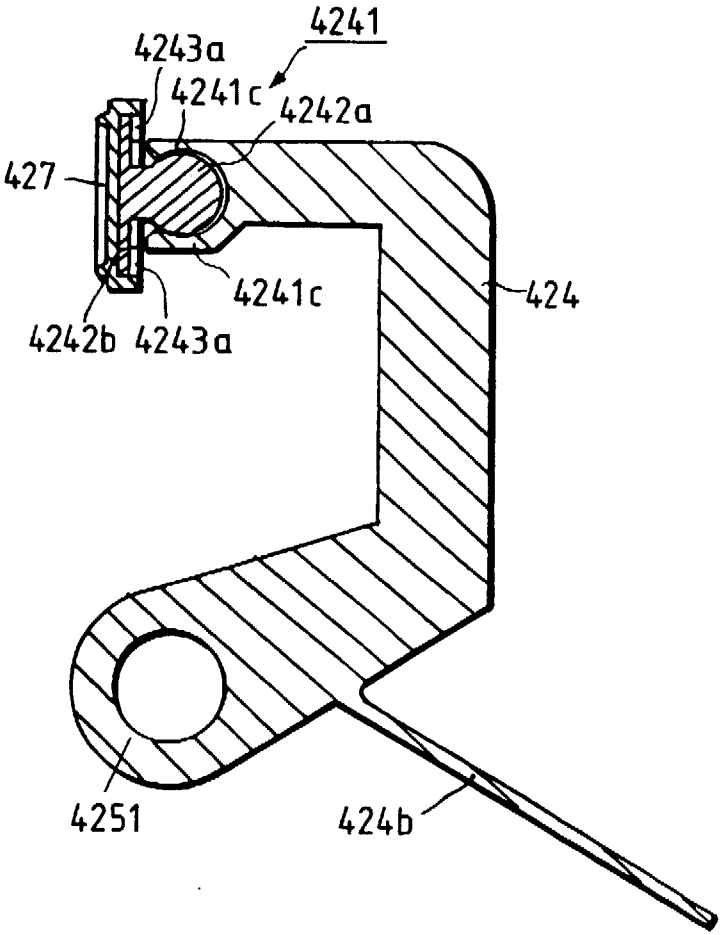
FIG. 49 is a sectional view showing the details of another embodiment of the cap unit in FIG. 46.
Figure 48:
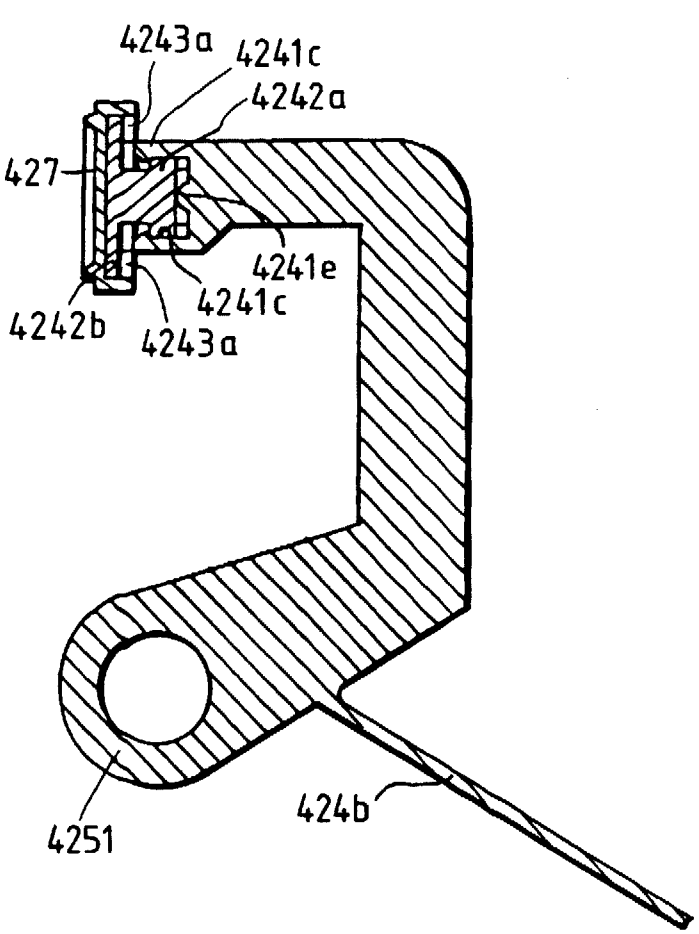
FIG. 48 is a sectional view of FIG. 46 showing the state of the cap holder 4242 mounted on the cap lever 4241.

FIG. 49 is a sectional view showing the details of another example of the cap unit.

The difference of this cap lever 424 from that shown in FIG. 46 is that the mounting portion 4242*a* of the cap holder 4241 is formed spherical, and also the hook portion 4241*c* of the cap lever 424 is formed in R-shape, so that predetermined plays may be created right and left, up and down between the cap holder 4241 and the hook portion 4241*c*. Even with such a constitution, the same effect as in the constitution of the cap lever 424 in FIG. 46 as described above can be obtained.

In short, since in the ink jet recording apparatus to which the above-mentioned constitution is applied, the mounting members of the cap are mounted on the movable member for moving the cap so as to be rockable in all the directions such as up and down, right and left, obliquely, etc., only a small head pressing force can be used to alleviate the power consumed of the driving system. Also, by use of a lead screw, the recording head will not come off from the position during capping, whereby positional precision can be exhibited with ease.

In addition, since a rib by use of an elastic material is provided so as to be adherable onto the recording surface of the head, even when the head may be slanted, the adhesivity between the discharging surface of the head and the cap could be made better.

Further, the constitution of an ink jet instrument with the high precision mechanism being made more highly precise by further reducing the noise, the momentum force of the driving motor 419 in FIG. 1 is shown in FIG. 50 to FIG. 53.

This constitution is characterized by provision of a transmission means for transmitting the driving force generated by the motor which generates the driving force for moving the carrier to the carrier, a supporting means which supports the motor rockably and an urging means which effects engagement between the motor and the transmission means by urging in a predetermined direction of rocking.

According to the constitution as mentioned above, since it has become possible to avoid the force acting on rotation of the force through the momentum of the carrier by rocking of the motor, a motor mounting hole is provided on the chassi 400 for supporting the carrier motor rotatably.

Figure 50:
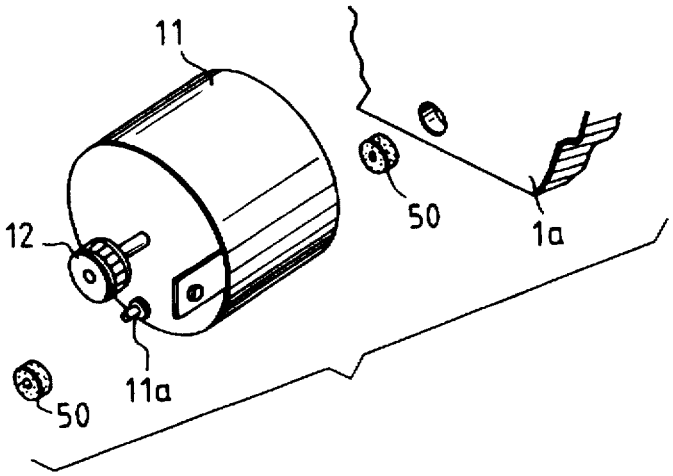
FIG. 50 is an exploded perspective view showing another embodiment mounted with a carrier motor shown in FIG. 1.

FIG. 50 shows the application of the rocking mechanism to the mounting method of the carrier motor 11 shown in FIG. 11. In the Figure, 50 is an elastic member comprising a rubber, etc., which has a hole at the center into which the rotatory pin 11*a* of the carrier motor is to be inserted. In this way, the rotatory pin 11*a* is mounted freely rotatably through the elastic member 50 in the motor mounting hole of the chassis 1, and therefore the carrier motor 11 becomes rotatable with the rotatory pin 11*a* as the rotation shaft.

As the result, vibration of the motor transmitted to the chassis, etc. is absorbed by the elastic member 50, whereby the noise caused by motor vibration is decreased.

Figure 51:
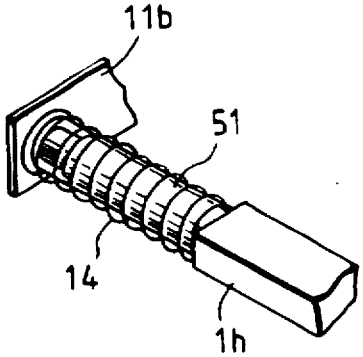
FIG. 51 is a perspective view showing another embodiment with the constitution for applying tension to the timing belt shown in FIG. 1.

FIG. 51 shows another embodiment with a constitution which provides a timing belt 13 by spanning by urging the carrier motor 11 in a predetermined direction. In the Figure, 51 is a damper having a gas or an oil sealed therein, of which one end of the two relatively movable portions is mounted on the spring receptacle 11*b*, while the other end is mounted on one end of the lead arm 1*h* and inserted into the spring 14.

With such a constitution, the momentum force during start-up and stopping of the carrier can be escaped, whereby the movement of the carrier motor 11 rotating around the rotatory pin 11*a* can be rapidly attenuated.

Figure 52A:
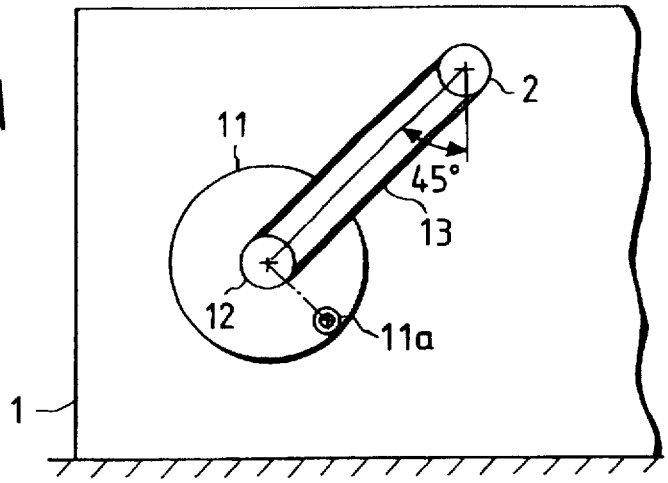
FIGS. 52A, 52B and 53 are schematic side views showing other embodiments with the constitution for acting similarly tension on the timing belt.
Figure 52B:
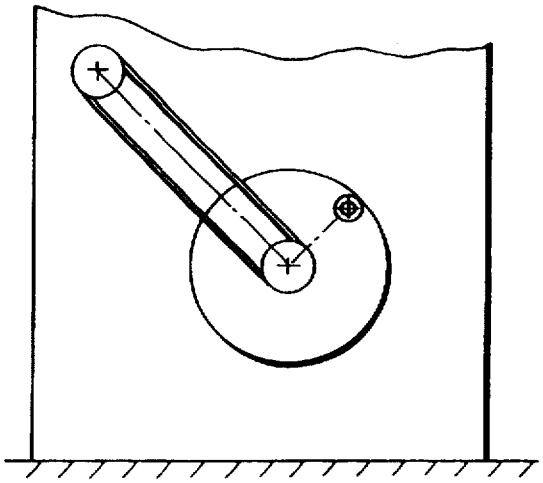

FIGS. 52A and 52B show another embodiment of the positional relationships between the lead screw 2 and the carrier motor 11. In this embodiment, when the apparatus is placed horizontally as shown in the same Figure A, the positional relationship is constituted such that the rotational center of the carrier motor 11 is positioned on the line of 45° from vertically downward of the rotational center of the lead screw 2.

As the result, even when the recording apparatus may be used vertically as shown in the same Figure B, the force acting on the timing belt 13 becomes equal to that when placed horizontally through the weight of the carrier motor 11. Thus, a constant force always acts on the belt 13 regardless of the use conditions of the apparatus.

Figure 53:
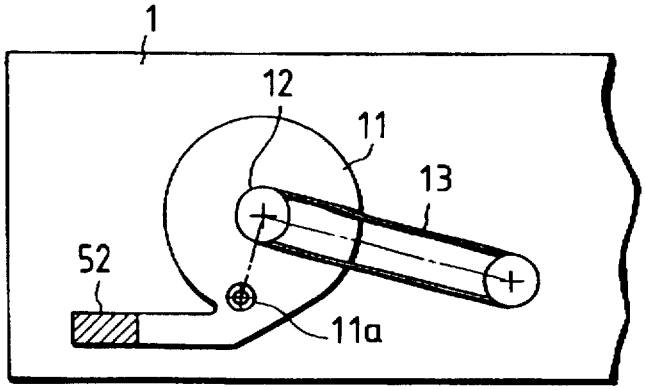

FIG. 53 shows still another embodiment of the embodiment shown in FIG. 52. In the Figure, 52 is a balancer mounted with an arm on the carrier motor 11. With such a constitution, the difference in force acting on the belt 13 can be absorbed to make the force constant by the weight of the motor due to the posture difference of the apparatus as described above, whereby it becomes possible to give a degree of freedom in the arrangement of the motor 11 and the lead screw 2.

Thus, by making the force acting on the timing belt 13 always constant by the weight of the motor 11, the spring 14 for acting finally a predetermined tension on the belt 13 is not required to have a great elastic force which can correspond to all the posture changes of the apparatus.

The constitution of driving the carrier according to the present invention in the embodiments as described above has been described by referring to the ink jet recording head, but it is evident that the recording head is not limited to the ink jet system.

Also, the constitution of the carrier mediating driving force as described above in the present embodiment is not limited to the lead screw driving system, but also applicable to wire, belt, etc., as a matter of course.

As is apparent from the above description, according to the present invention, it becomes possible to escape the force acting on the rotation of the motor by the momentum of the carrier by way of rocking of the motor.

As the result, generation of vibration on the motor by the momentum during movement, stopping of the carrier can be prevented, whereby the noise caused by the motor can be decreased.

Also, by use of an inexpensive and easily controllable pulse motor as the carrier motor, this can be controlled by an open loop, and also a recording apparatus with little reversal sound of the carrier can be realized with a carrier driving mechanism having a simple constitution.

Next, a preferable constitution as modification embodiment of the constitution shown in FIGS. 21 to 23 is to be described in connection with the head portion constitution. The adhering pad 350 is described by referring to FIGS. 54 to 57.

FIGS. 54 to 57 show an embodiment in which the pressure change within the cap member which occurs by covering of the cap member over the discharge port surface in the capping actuation is made so as to have no influence on the meniscus within the discharge port even under various bad conditions, which embodiment is characterized in that an adhering member is equipped, which forms a space including the space near the discharge port hermetically closed with the above-mentioned covering actuation, with its internal invariable pressure with the above-mentioned covering actuation, as accompanied with the covering actuation of the cap member as mentioned above.

With such a constitution as mentioned above, a predetermined space with invariable pressure including the vicinity of the discharge port as accompanied with the actuation of the cap member covering over the discharge port surface is formed. In this way, retreating of the meniscus position within the discharge port can be prevented by the capping actuation.

Figure 54:
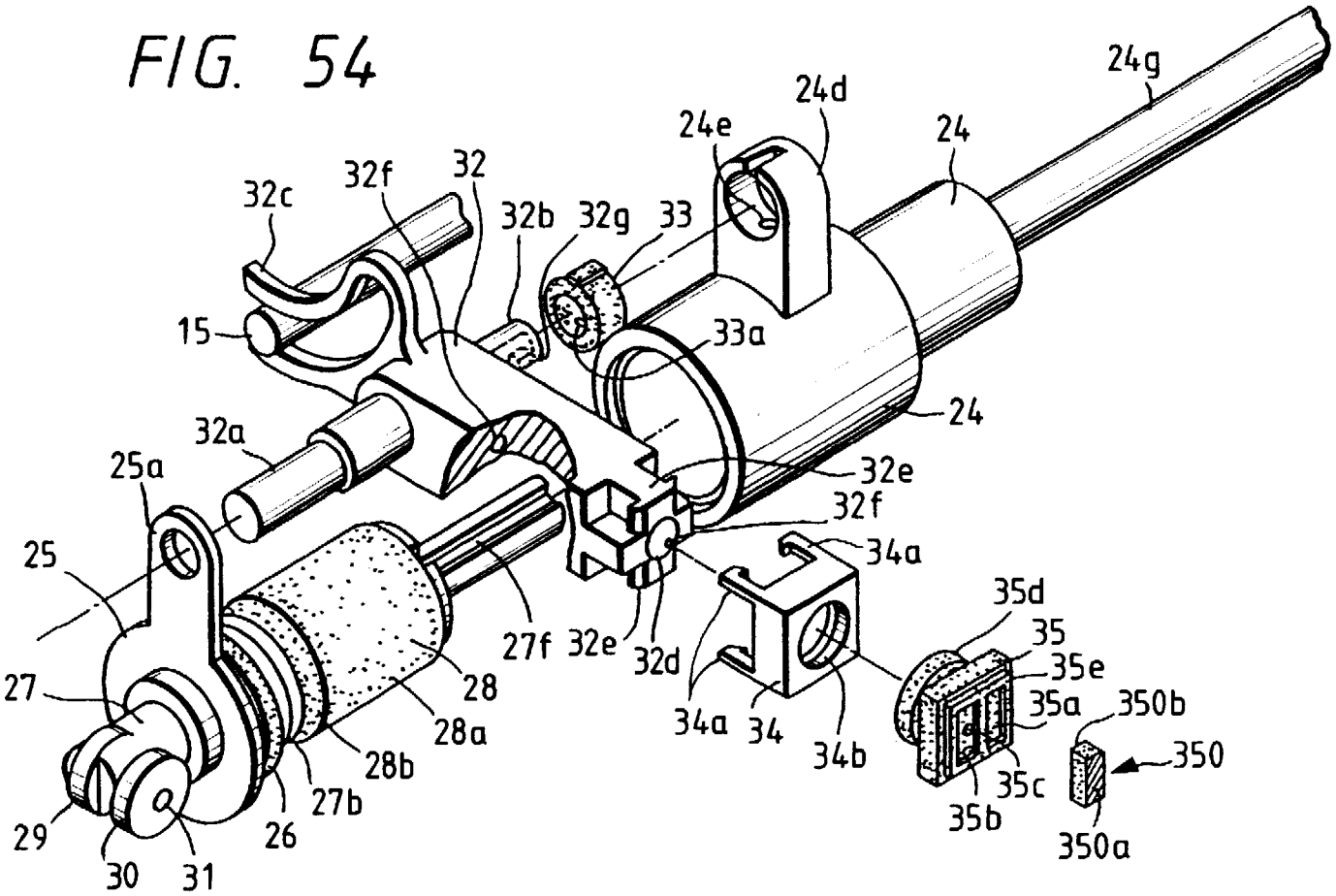
FIG. 54 is an exploded perspective view showing an embodiment of the suction recovery system for the recording head having an adhering pad 350 added in FIG. 3.

In FIG. 54, description of the same constitution as that in FIG. 3 is omitted.

350 is an adhering pad mounted on the closed cap 35*a* which contacts the discharge port surface of the recording head during capping, and is formed of a foamed urethane foamed communicatingly. The surface of the adhering pad 350 which contacts the discharge port surface is formed a solid layer (skin film) 350*a* having the same difficult deformability as described above formed during molding of the foamed urethane, and ensures the sealing effect when adhered onto the discharge port surface. The adhering pad 350 is mounted onto the closed cap 35*a* by plastering the surface 350*b* on the opposite side to the surface where 350*a* is formed to the seat surface of the closed cap 35*a* with a double-side tape or an adhesive, etc.

The state of the capping state as mentioned above is described in detail below.

Figure 55A:
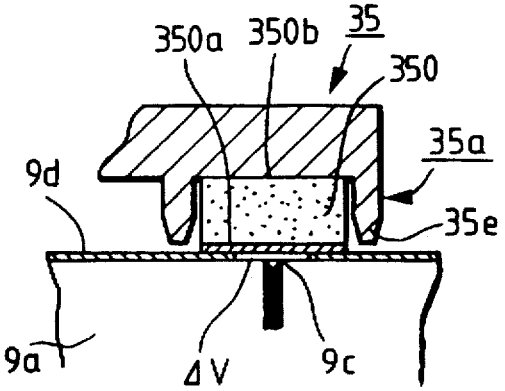
FIGS. 55A and 55B are side sectional views showing the capping actuations according to an embodiment of the present invention.

First, as shown in FIG. 55A, the solid layer 350*a* of the adhering pad 350 is adhered onto the discharge port forming surface 9*d* to contact the front seal plate 90*a* having an opening in the vicinity of the discharge port, and the space ΔV formed at the opening portion is closed by this contact.

Figure 55B:
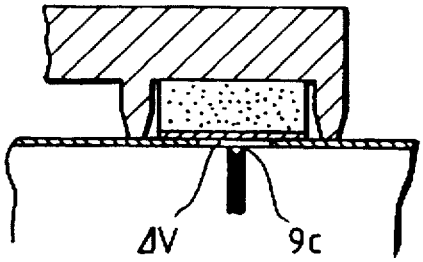

Then, as shown in FIG. 55B, even if further the cap 35 may be pushed, whereby the cap seal portion 35*e* contacts the front seal plate 90*a* to increase the pressure within the closed cap 35*e*, the solid layer 350*a* will not be deformed by the pressure change and therefore the pressure within the space ΔV will not be changed. In this way, the meniscus within the discharge port 91 can always maintain a constant position without retreating.

Also, the equalizing function of the cap member as mentioned above is excellent, and even when there is a stepped difference at the discharge port forming surface, can maintain stable closed state by absorbing instantly the stepped difference.

Figure 56:
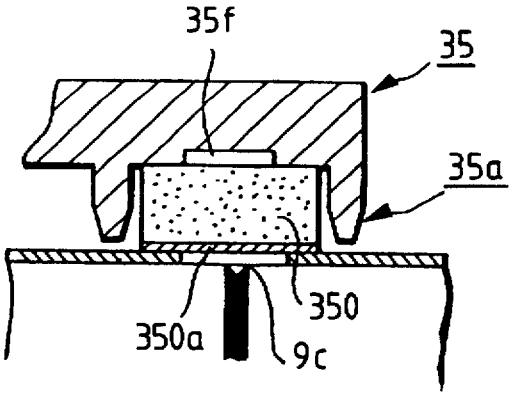
FIGS. 56 and FIG. 57 are respectively side sectional views showing the capping actuation according to other embodiments of the present invention.

FIG. 56 is a side sectional view for illustration of the capping actuation according to still another embodiment of the present invention. As shown in the same Figure, the closed cap 35*a* of this embodiment has a concavity 35*f* with the same shape as the opening of the front seal plate 90*a* formed on the seat surface on which the adhering pad 350 is mounted.

With such a constitution, the change of the pressure to be elevated within the cap 35*a* when the cap 35*a* is further pushed from the state shown in the same Figure is alleviated by the increase of volume of the concavity 35*f*, particularly making the pressure on the solid layer 350*a* at the portion corresponding to the discharge port portion smaller. As the result, no deformation of the solid layer 350*a* by the pressure elevation due to pushing of the closed cap 35*a* is further ensured.

Figure 57:
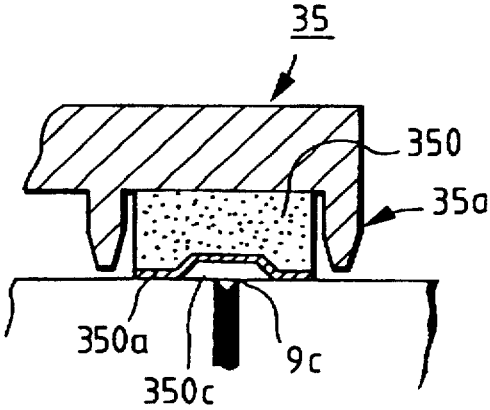

FIG. 57 is a side sectional view for illustration of the capping actuation according to still another embodiment of the capping constitution of the present invention. As shown in the same Figure, the solid layer 350*a* of this embodiment has its portion opposed to the discharge port 9*c* molded in concave shape. In this way, the present invention is also applicable to the closed cap which is used together with the recording head having no front surface seal plate, and a predetermined space not affected in pressure change by the contact of the adhering pad 350 against the discharge port surface can be formed.

Figure 59:
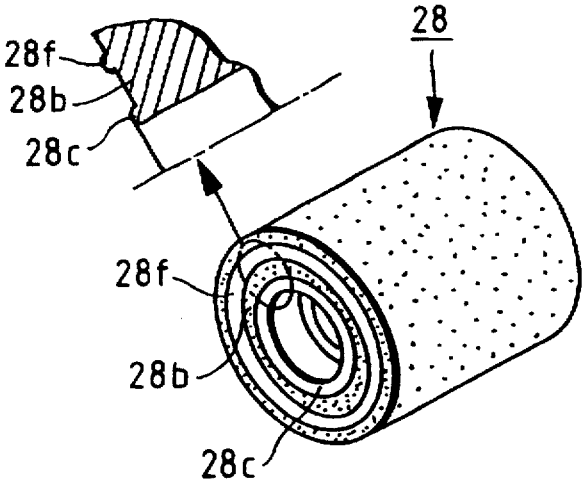
FIG. 59 is a perspective view of the piston according to another embodiment of the present invention.
Figure 60:
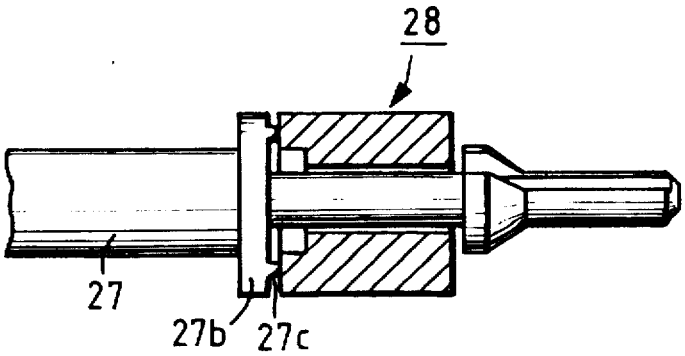
FIG. 60 is a side sectional view showing the engaged state of the piston 28 and the piston presser according to still another embodiment of the present invention.

Finally, modified embodiments of the piston 28 to be applied to FIGS. 9A and 9B are shown in FIG. 59 to FIG. 60. The piston 28 of the pump means having the effects of miniaturization and ink thickening prevention effect as described in Fig. A, B is made to have a constitution in which the annular contact portion, which blocks the route for discharging ink in the actutation according to suction through contact, and forms the route for said discharging in the actuation according to discharging through separation, is provided on either the end surface of the piston or the end surface of the pushing member which pushes the end surface in the suction actuation.

Figure 58:
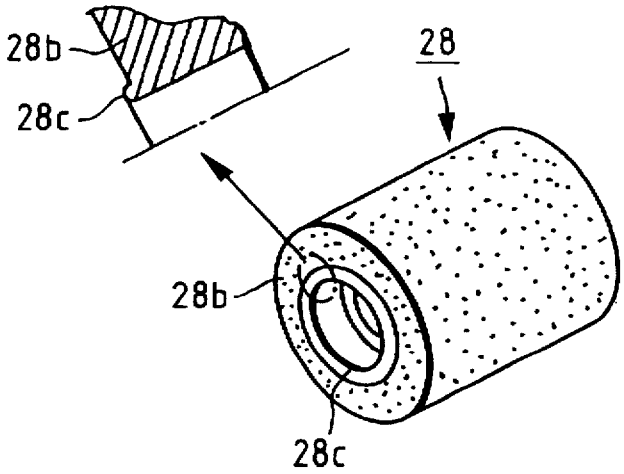
FIG. 58 is a perspective view of another embodiment of the piston 28.

In FIG. 58, 28*c* is a seal rib provided on one end surface 28*b* of the piston 28 concentrically with the same end surface, of which lateral cross-section is semispherical. The seal rib 28*c* is the site which contacts directly the piston presser 27*b* when the piston 28 and the piston presser 27*b* actuate with engagement, and its sealability becomes better through contact along a line as a whole, and also can be rapidly separated from the piston presser without influence from the viscosity of the ink.

FIG. 59 is a perspective view of the piston showing another embodiment of the piston 28 of the present invention. As shown in the same Figure, in this embodiment, in addition to the seal rib 28 at the end surface 28*b*, a seal rib 28*f* is provided at the peripheral portion thereof. In this way, sealability in valve action during ink suction is improved.

FIG. 60 is a side sectional view showing the engaged state of the piston presser and the piston according another embodiment of the piston 28 of the present invention. As shown in the same Figure, in this embodiment, an annular seal rib 27*c* is provided on the end surface of the piston presser 27*b*, and the end surface of the piston 28 is made flat.

According to this embodiment, since the rib 27*c* contacts the end surface of the piston 28 when the piston 28 is pushed through the piston presser 27*b*, the amount of the rib 27*c* bitten onto the end surface can be small, whereby the positional relationship during piston actuation can be stabilized.

In the suction pump constituting the valve function by use of the end surface of the piston, through contact between the end surface of the piston and the end surface of the pushing member at an annular line, sealability becomes better in blocking the exhausting route during suction, and also a exhausting route can be formed by rapid separation regardless of the viscosity of the ink during exhausting.

As the result, suction and exhausting actuations of the pump can be done well.

Also, defective phenomenon such as impairment of the actuation of pump through attachment of ink, grease or dust, etc. on the contact portion will occur with difficulty, and further no counterflow of ink toward the recording head side is generated during discharging, whereby a suction pump and an ink jet recording apparatus of high reliability can be obtained.

The above constitutions of the respective parts can be combined adequately based on the technical contents as described above in giving rise to miniaturization, high precision, high effect of the present invention, and these are included within the scope of the present invention.

The recording head of the present invention may have the above-described structure wherein the flow passage is linear and the liquid is ejected in the direction from one edge of the heater to the other edge, in the structure where the liquid passage is bent at the position of the electrothermal transducer to eject the liquid in the direction perpendicular to the surface of the electrothermal transducer element, or the structure wherein the passage is bent at an angle not 90 degrees as disclosed in U.S. Pat. Nos. 4,558,333 and 4,459,600. Also, the present invention is applicable to the structure disclosed in a Japanese Laid-Open Patent Application 59-123670 wherein a common slit is formed to provide the ejecting portions relative to the plural electrothermal transducers or to the structures disclosed in Japanese Laid-open Patent Application 59-138461 wherein the pressure wave produced by the thermal energy is absorbed by an opening provided for the ejecting outlet. The present invention is also applicable to the recording substrate, recording head or the recording apparatus for multi- or full-color recording apparatus wherein plural recording heads are used in combination or as a unit.

We claim:

1. An ink jet printing apparatus comprising:

a carrier mounting a print head with a discharge port forming surface having therein a discharge port for discharging ink, said carrier being movable between a printing area for printing on a printing medium by said printing head and a non-printing area adjacent to the printing area;

a cap, disposed in the non-printing area, having at least two adjacent chambers and being shiftable between a contact position for contacting and covering said discharge port forming surface in the non-printing area and a retracted position spaced apart from said discharge port forming surface, one of said chambers comprising a suction chamber for applying negative pressure to said discharge port when said cap is in the contact position with said suction chamber covering said discharge port forming surface and the other of said chambers having a porous member associated therewith and comprising a sealing chamber for maintaining said discharge port substantially out of communication with the atmosphere when said cap is in the contact position with said sealing chamber covering said discharge port forming surface; and suction means connected to said suction chamber for generating negative pressure therein.

2. An ink jet printing apparatus according to claim 1, wherein said cap operates in a first mode for performing a suction operation when said suction chamber covers said discharge port in association with movement of said carrier and a second mode in which ink discharge is stopped and said sealing chamber covers said discharge port.

3. An ink jet printing apparatus comprising:

a print head with a discharge port forming surface having therein a discharge port for discharging ink; and a cap having at least two adjacent chambers and being shiftable between a contact position for contacting and covering said discharge port forming surface and a retracted position spaced apart from said discharge port forming surface, one of said chambers comprising a suction chamber having a connecting port for receiving negative pressure from a suction device when said cap is in the contact position with said suction chamber covering said discharge port forming surface and the other of said chambers having a porous member associated therewith and comprising a sealing chamber for maintaining said discharge port substantially out of communication with the atmosphere when said cap is in the contact position with said sealing chamber covering said discharge port forming surface, wherein an area of said cap in contact with said print head when said suction chamber is covering said discharge port forming surface is smaller than an area of said cap in contact with said print head when said sealing chamber is covering said discharge port forming surface.

4. An apparatus according to claim 3, wherein said discharge port is deviated from a center of said discharge port forming surface toward a side thereof facing said sealing chamber.

5. An apparatus according to claim 3, wherein said print head has an electrothermal converting element for generating energy used for discharging the ink.

* * * * *

UNITED STATES PATENT AND TRADEMARK OFFICE

CERTIFICATE OF CORRECTION

PATENT NO. : 5,757,397

DATED : May 26, 1998

INVENTOR(S) : HIROFUMI HIRANO ET AL.

It is certified that error appears in the above-identified patent and that said Letters Patent is hereby corrected as shown below:

[56] REFERENCES CITED

Foreign Patent Documents
"53-123670" should read --59-123670--.

COLUMN 1

Line 64, "miniaturation" should read --miniaturization--.

COLUMN 2

Line 1, "deposited" should be deleted.
Line 2, "ink" should read --ink deposited--.
Line 8, "front" should read --from--.
Line 33, "the needle" should read --a needle--; and "a tube" should read --the tube--.

COLUMN 8

Line 67, "the" (second occurrence) should be deleted.

COLUMN 9

Line 2, "surface good," should read --surface,--.

UNITED STATES PATENT AND TRADEMARK OFFICE

CERTIFICATE OF CORRECTION

PATENT NO. : 5,757,397

DATED : May 26, 1998

INVENTOR(S) : HIROFUMI HIRANO ET AL.

It is certified that error appears in the above-identified patent and that said Letters Patent is hereby corrected as shown below:

COLUMN 10

Line 20, "cut" should read --cut at--.
Line 34, "to" (first occurrence) should read --so--.

COLUMN 18

Line 63, "intermedite" should read --intermediate--.

COLUMN 20

Line 27, "flexably" should read --flexibly--.

COLUMN 22

Line 2, "the 402a," should read --402a,--.

COLUMN 23

Line 6, "miniatuarized." should read --miniaturized.--.
Lines 7-8, "singleth-read" should read --single thread--.
Line 56, "provided" should read --is provided--.

COLUMN 26

Line 10, "the" should be deleted.

UNITED STATES PATENT AND TRADEMARK OFFICE

CERTIFICATE OF CORRECTION

PATENT NO. : 5,757,397

DATED : May 26, 1998

INVENTOR(S) : HIROFUMI HIRANO ET AL.

It is certified that error appears in the above-identified patent and that said Letters Patent is hereby corrected as shown below:

COLUMN 27

Line 14, "the" (first occurrence) should read --of the--.
Line 32, "was" should read --is--.
Line 33, "a rubber cup" should read --rubber cap--.
Line 39, "accomplishes" should read --accomplish--.

COLUMN 29

Line 8, "chassi" should read --chassis--.

COLUMN 30

Line 49, "a" should read --of a--.

COLUMN 31

Line 67, "another" should read --to another--.

Signed and Sealed this

Ninth Day of February, 1999

*Attest:*

*Attesting Officer*

*Acting Commissioner of Patents and Trademarks*